US008028773B2

(12) United States Patent
Singh et al.

(10) Patent No.: US 8,028,773 B2
(45) Date of Patent: Oct. 4, 2011

(54) DRILL BIT AND CUTTER ELEMENT HAVING A FLUTED GEOMETRY

(75) Inventors: Amardeep Singh, Houston, TX (US); Mohammed Boudrare, Bossier City, LA (US)

(73) Assignee: Smith International, Inc., Houston, TX (US)

( * ) Notice: Subject to any disclaimer, the term of this patent is extended or adjusted under 35 U.S.C. 154(b) by 240 days.

(21) Appl. No.: 12/015,054

(22) Filed: Jan. 16, 2008

(65) Prior Publication Data

US 2009/0178856 A1 Jul. 16, 2009

(51) Int. Cl.
*E21B 10/16* (2006.01)

(52) U.S. Cl. ..... 175/430; 175/432; 175/331

(58) Field of Classification Search ..... 175/430, 175/431, 432, 428, 374
See application file for complete search history.

(56) References Cited

U.S. PATENT DOCUMENTS

| | | | | | |
|---|---|---|---|---|---|
| 4,148,368 | A * | 4/1979 | Evans | 175/428 |
| 5,154,245 | A * | 10/1992 | Waldenstrom et al. | 175/420.2 |
| 5,868,213 | A * | 2/1999 | Cisneros et al. | 175/331 |
| 5,928,071 | A * | 7/1999 | Devlin | 451/547 |
| 6,059,054 | A * | 5/2000 | Portwood et al. | 175/430 |
| 6,065,552 | A * | 5/2000 | Scott et al. | 175/374 |
| 6,105,694 | A * | 8/2000 | Scott | 175/428 |
| 6,148,938 | A * | 11/2000 | Beaton | 175/432 |
| 6,161,634 | A * | 12/2000 | Minikus et al. | 175/331 |
| 6,196,340 | B1 * | 3/2001 | Jensen et al. | 175/431 |
| 6,241,034 | B1 * | 6/2001 | Steinke et al. | 175/331 |
| 6,619,411 | B2 * | 9/2003 | Singh et al. | 175/57 |
| 6,883,624 | B2 * | 4/2005 | McDonough | 175/428 |
| 6,929,079 | B2 * | 8/2005 | McDonough et al. | 175/420.1 |
| 2008/0156542 | A1 * | 7/2008 | Baker et al. | 175/331 |
| 2008/0164069 | A1 * | 7/2008 | McDonough et al. | 175/374 |
| 2010/0126775 | A1 * | 5/2010 | Crawford et al. | 175/61 |

FOREIGN PATENT DOCUMENTS

WO WO2008014343 1/2008

OTHER PUBLICATIONS

Merriam-Webster Dictionary definition of "Chisel", accessed Nov. 16, 2010 at www.merriam-webster.com.*

* cited by examiner

*Primary Examiner* — David Bagnell
*Assistant Examiner* — Blake Michener
(74) *Attorney, Agent, or Firm* — Christie, Parker & Hale, LLP.

(57) ABSTRACT

A drill bit for cutting a borehole having a borehole sidewall, corner and bottom, includes a bit body having a bit axis and a rolling cone cutter mounted on the bit body and adapted for rotation about a cone axis. Further, the drill bit includes at least one insert having a base portion secured in the rolling cone cutter and having a cutting portion extending therefrom. The cutting portion of the at least one insert has a cutting surface including at least one flute.

29 Claims, 12 Drawing Sheets

DRILL BIT AND CUTTER ELEMENT HAVING A FLUTED GEOMETRY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE TECHNOLOGY

1. Field of the Invention

The invention relates generally to earth-boring bits used to drill a borehole for the ultimate recovery of oil, gas or minerals. More particularly, the invention relates to rolling cone rock bits and to an improved cutting structure and cutter element for such bits.

2. Background Information

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Because drilling costs are typically thousands of dollars per hour, it is thus always desirable to employ drill bits which will drill faster and longer and which are usable over a wider range of formation hardness. The length of time that a drill bit may be employed before it must be changed depends upon its rate of penetration ("ROP"), as well as its durability.

An earth-boring bit in common use today includes one or more rotatable cutters that perform their cutting function due to the rolling movement of the cutters acting against the formation material. The cutters roll and slide upon the bottom of the borehole as the bit is rotated, the rotatable cutters thereby engaging and disintegrating the formation material in their path. The rotatable cutters may be described as generally conical in shape and are therefore sometimes referred to as rolling cones or rolling cone cutters. The borehole is formed as the action of the rotary cones remove chips of formation material which are carried upward and out of the borehole by drilling fluid which is pumped downwardly through the drill pipe and out of the bit.

The earth disintegrating action of the rolling cone cutters is enhanced by providing the cutters with a plurality of cutter elements or inserts. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are known as "steel tooth bits." In each instance, the cutter elements on the rotating cutters break up the formation to form the new borehole by a combination of gouging and scraping or chipping and crushing. The geometry, materials, and positioning of the cutter elements (both steel teeth and tungsten carbide inserts) upon the cone cutters greatly impact bit durability and ROP and thus, are important to the success of a particular bit design.

The inserts in TCI bits are typically positioned in circumferential rows on the rolling cone cutters. Most such bits include a row of inserts in the heel surface of the rolling cone cutters. The heel surface is a generally frustoconical surface configured and positioned so as to align generally with and ream the sidewall of the borehole as the bit rotates. In addition, conventional bits typically include a circumferential gage row of cutter elements mounted adjacent to the heel surface but oriented and sized in such a manner so as to cut the corner of the borehole. Further, conventional bits also include a number of inner rows of cutter elements that are located in circumferential rows disposed radially inward or in board from the gage row. These cutter elements are sized and configured for cutting the bottom of the borehole, and are typically described as inner row cutter elements.

Earthen formations generally undergo two types of fractures when penetrated by a cutter element that protrudes from a rolling cone of a drill bit. A first type of fracture is generally referred to as a plastic fracture, and is the type of fracture where the cutter element penetrates into the rock and volumetrically displaces the rock by compressing and crushing it. In this circumstance, shearing or tearing fracture, rather than tensile fracture, is the major mode of crack propagation. This type of fracture generally creates a crater in the rock that is the size and shape of that portion of the cutter element that has penetrated into the rock.

A second principal type of fracture is what is referred to as a brittle fracture. A brittle fracture typically occurs after a plastic fracture has first taken place. That is, when the rock first undergoes plastic fracture, a region around the crater made by the cutter element will experience increased tensile stress, will weaken, and may crack in that region, even though the rock in that region surrounding the crater has not been volumetrically displaced by the cutter element. This region of increased stress is generally recognized as the "Hertzian" contact zone. In certain formations, when the cutter element displaces enough of the rock and creates sufficient stress in the Hertzian contact zone proximal the plastic fracture, rock in the Hertzian contact zone may itself break and chip away from the crater. Where this brittle fracture occurs, the cutter element effectively removes a volume of rock that is larger than the volume of rock displaced in the plastic fracture.

The characteristics of these fractures depend largely on the geometry of the cutter element and the properties of the rock that is being penetrated. In general, for a given formation, a sharper insert will generally create more of a plastic fracture, whereas a more blunt cutter element will produce more of a brittle fracture. However, the more blunt insert will typically require a higher force and WOB to penetrate to the same depth into the rock as compared to a sharper cutter element. Because a brittle fracture provides for additional rock removal as compared to a plastic fracture alone, it would be advantageous to provide a cutter element suitable for inducing brittle fractures that would perform that function without requiring increased force or weight on bit.

Accordingly, increasing ROP while maintaining good cutter and bit life to increase the footage drilled is still an important goal so as to decrease drilling time and recover valuable oil and gas more economically. To increase a bit's rate of penetration (ROP), it is desirable to increase the bit's ability to initiate brittle fractures at the locations where the cutter element engages the formation material so that the volume of rock removed by each hit or impact of the cutter element is greater than the volume of rock actually penetrated by the cutter element.

SUMMARY OF SOME OF THE PREFERRED EMBODIMENTS

In accordance with at least one embodiment of the invention, a cutting element for a drill bit comprises a base portion. In addition, the cutting element comprises a cutting portion extending from the base portion and having a cutting surface. The cutting surface includes an elongate chisel crest and at least one flute that extends along the cutting surface to the elongate chisel crest.

In accordance with other embodiments of the invention, a drill bit for cutting a borehole having a borehole sidewall, corner and bottom, comprises a bit body including a bit axis. In addition, the drill bit comprises a rolling cone cutter mounted on the bit body and adapted for rotation about a cone axis. Further, the drill bit comprises at least one insert having a base portion secured in the rolling cone cutter and having a cutting portion extending therefrom. The cutting portion of the at least on insert has a cutting surface including at least one flute.

In accordance with another embodiment of the invention, a drill bit for cutting a borehole having a borehole sidewall, corner and bottom, comprises a bit body having a bit axis. In addition, the drill bit comprises a rolling cone cutter mounted on the bit body and adapted for rotation about a cone axis. Further, the drill bit comprises a plurality of inserts mounted in an inner row on the rolling cone cutter. Each insert comprises a base portion secured in the rolling cone cutter and a cutting portion extending from the base portion, the cutting portion having a cutting surface and including a crest and at least one flute extending in a spiral about the cutting surface.

Thus, the embodiments described herein comprise a combination of features and characteristics which are directed to overcoming some of the shortcomings of prior bits and cutter element designs. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiment of the present invention, reference will now be made to the accompanying drawings wherein.

DETAILED DESCRIPTION OF THE PREFERRED EMBODIMENTS

Figure 1:
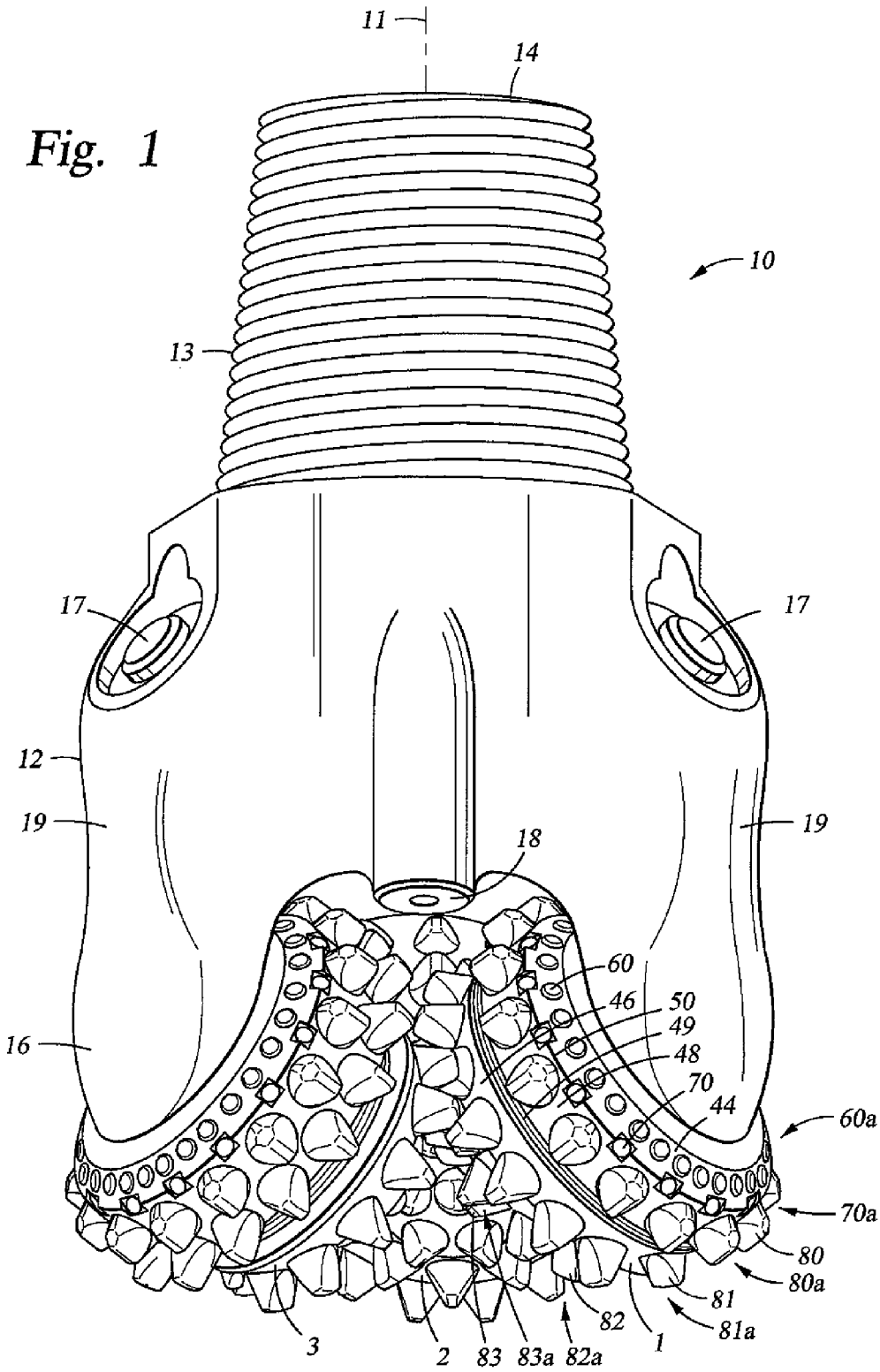
FIG. 1 is a perspective view of an earth-boring bit.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Referring first to FIG. 1, an earth-boring bit 10 is shown to include a central axis 11 and a bit body 12 having a threaded pin section 13 at its upper end that is adapted for securing the bit to a drill string (not shown). The uppermost end will be referred to herein as pin end 14. Bit 10 has a predetermined gage diameter as defined by the outermost reaches of three rolling cone cutters 1, 2, 3 which are rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters. Bit legs 19 include a shirttail portion 16 that serves to protect the cone bearings and cone seals from damage as might be caused by cuttings and debris entering between leg 19 and its respective cone cutter.

Figure 2:
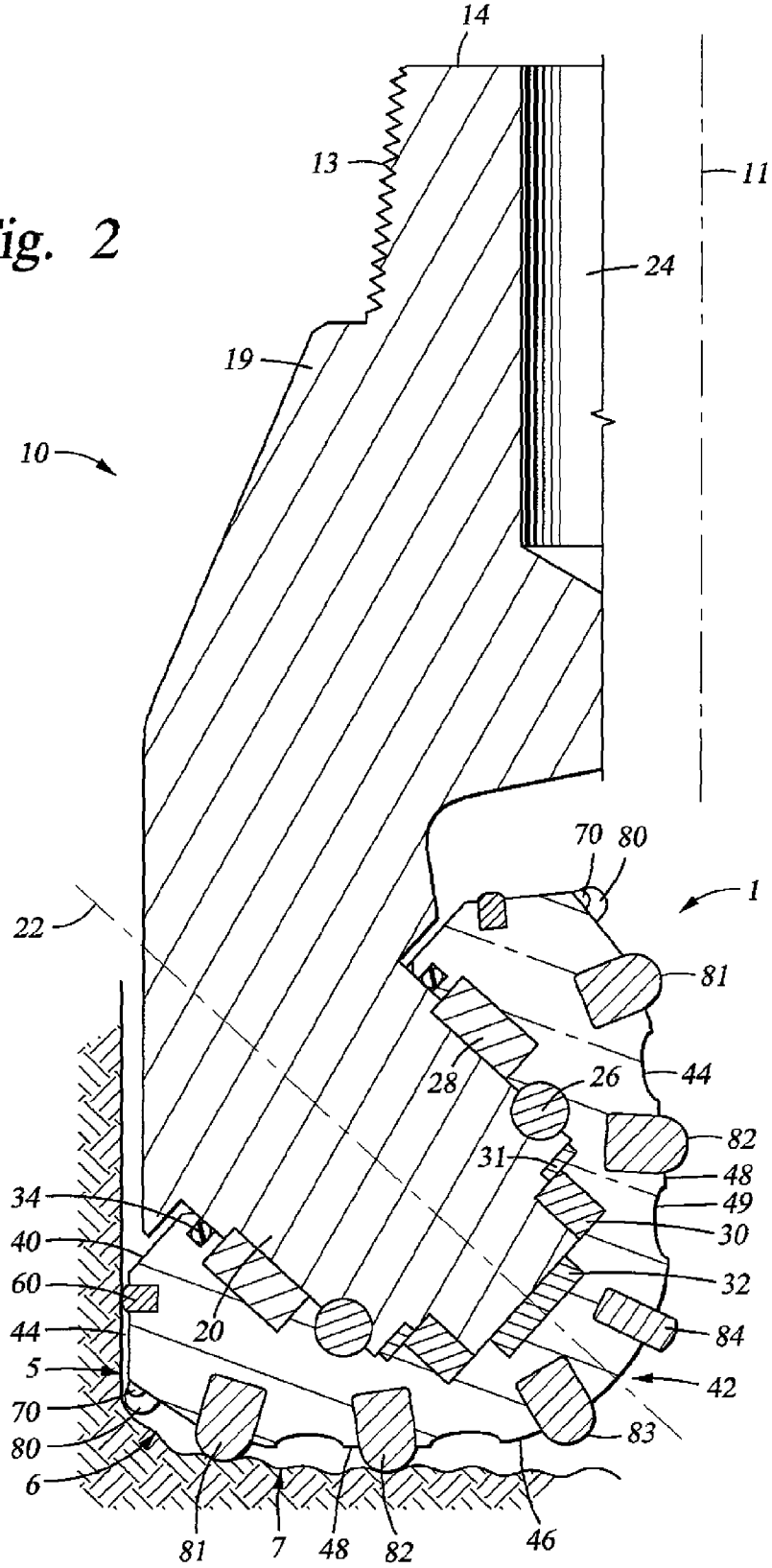
FIG. 2 is a partial section view take through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial and axial thrust are absorbed by roller bearings 28, 30, thrust washer 31 and thrust plug 32. The bearing structure shown is generally referred to as a roller bearing; however, the invention is not limited to use in bits having such structure, but may equally be applied in a bit where cone cutters 1-3 are mounted on pin 20 with a journal bearing or friction bearing disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Referring still to FIGS. 1 and 2, each cone cutter 1-3 includes a generally planar backface 40 and nose portion 42. Adjacent to backface 40, cutters 1-3 further include a generally frustoconical surface 44 that is adapted to retain cutter elements that scrape or ream the sidewalls of the borehole as the cone cutters rotate about the borehole bottom. Frustoconical surface 44 will be referred to herein as the "heel" surface of cone cutters 1-3. It is to be understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Frustoconical heel surface 44 and conical surface 46 converge in a circumferential edge or shoulder 50, best shown in FIG. 1. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions or bands 48 generally referred to as "lands" which are employed to support and secure the cutter elements as described in more detail below. Grooves 49 are formed in cone surface 46 between adjacent lands 48.

In the bit shown in FIGS. 1 and 2, each cone cutter 1-3 includes a plurality of wear resistant cutter elements in the form of inserts which are disposed about the cone and arranged in circumferential rows in the embodiment shown. More specifically, rolling cone cutter 1 includes a plurality of heel inserts 60 that are secured in a circumferential row 60*a* in the frustoconical heel surface 44. Cone cutter 1 further includes a first circumferential row 70*a* of gage inserts 70 secured to cone cutter 1 in locations along or near the circumferential shoulder 50. Additionally, the cone cutter includes a second circumferential row 80*a* of gage inserts 80. The cutting surfaces of inserts 70, 80 have differing geometries, but each extends to full gage diameter. Row 70*a* of the gage inserts is sometimes referred to as the binary row and inserts 70 sometimes referred to as binary row inserts. The cone cutter 1 further includes inner row inserts 81, 82, 83 secured to cone surface 46 and arranged in concentric, spaced-apart inner rows 81*a*, 82*a*, 83*a*, respectively. Heel inserts 60 generally function to scrape or ream the borehole sidewall 5 to maintain the borehole at full gage and prevent erosion and abrasion of the heel surface 44. Gage inserts 80 function primarily to cut the corner of the borehole. Binary row inserts 70 function primarily to scrape the borehole wall and limit the scraping action of gage inserts 80 thereby preventing gage inserts 80 from wearing as rapidly as might otherwise occur. Inner row cutter elements 81, 82, 83 of inner rows 81*a*, 82*a*, 83*a* are employed to gouge and remove formation material from the remainder of the borehole bottom 7. Insert rows 81*a*, 82*a*, 83*a* are arranged and spaced on rolling cone cutter 1 so as not to interfere with rows of inner row cutter elements on the other cone cutters 2, 3. Cone 1 is further provided with relatively small "ridge cutter" cutter elements 84 in nose region 42 which tend to prevent formation build-up between the cutting paths followed by adjacent rows of the more aggressive, primary inner row cutter elements from different cone cutters. Cone cutters 2 and 3 have heel, gage and inner row cutter elements and ridge cutters that are similarly, although not identically, arranged as compared to cone 1. The arrangement of cutter elements differs as between the three cones in order to maximize borehole bottom coverage, and also to provide clearance for the cutter elements on the adjacent cone cutters.

In the embodiment shown, inserts 60, 70, 80-83 each includes a generally cylindrical base portion, a central axis, and a cutting portion that extends from the base portion, and further includes a cutting surface for cutting the formation material. The base portion is secured by interference fit into a mating socket drilled into the surface of the cone cutter. In general, the cutting surface of an insert refers to the surface of the insert that extends beyond the surface of the cone cutter.

Figure 4:
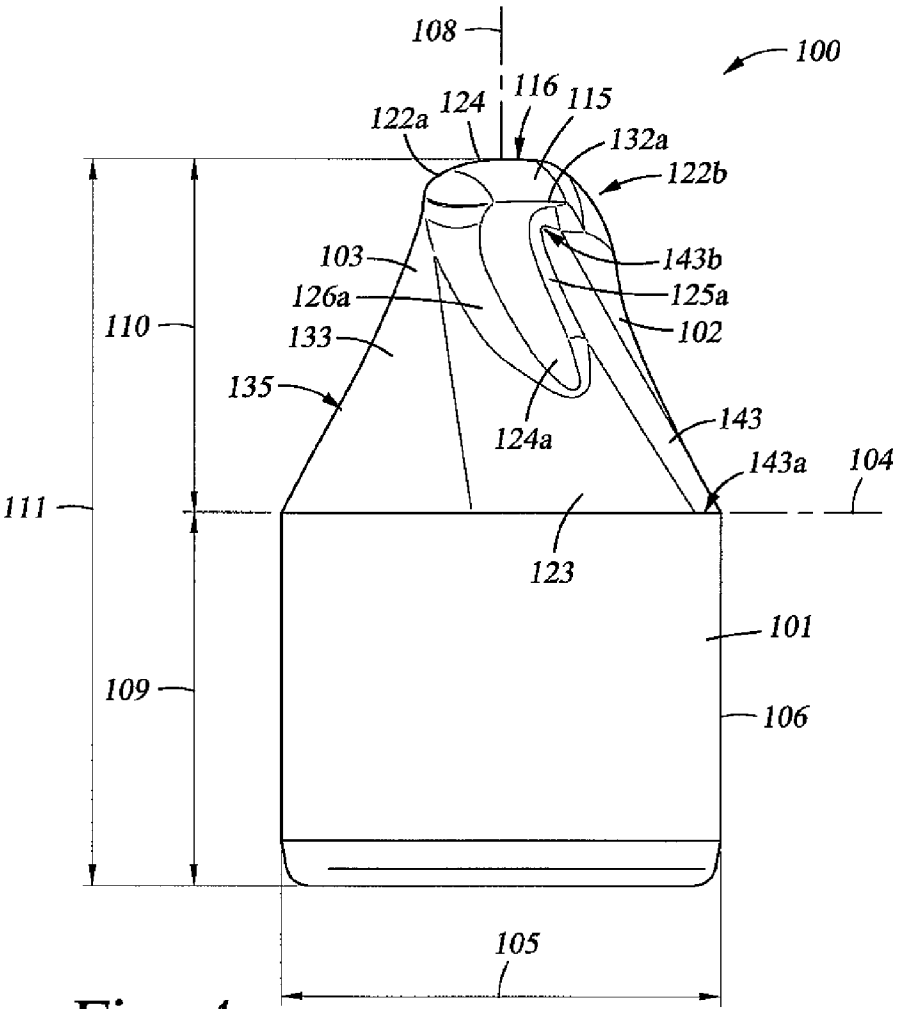
FIG. 4 is a side elevation view of the cutter element shown in FIG. 3.
Figure 3:
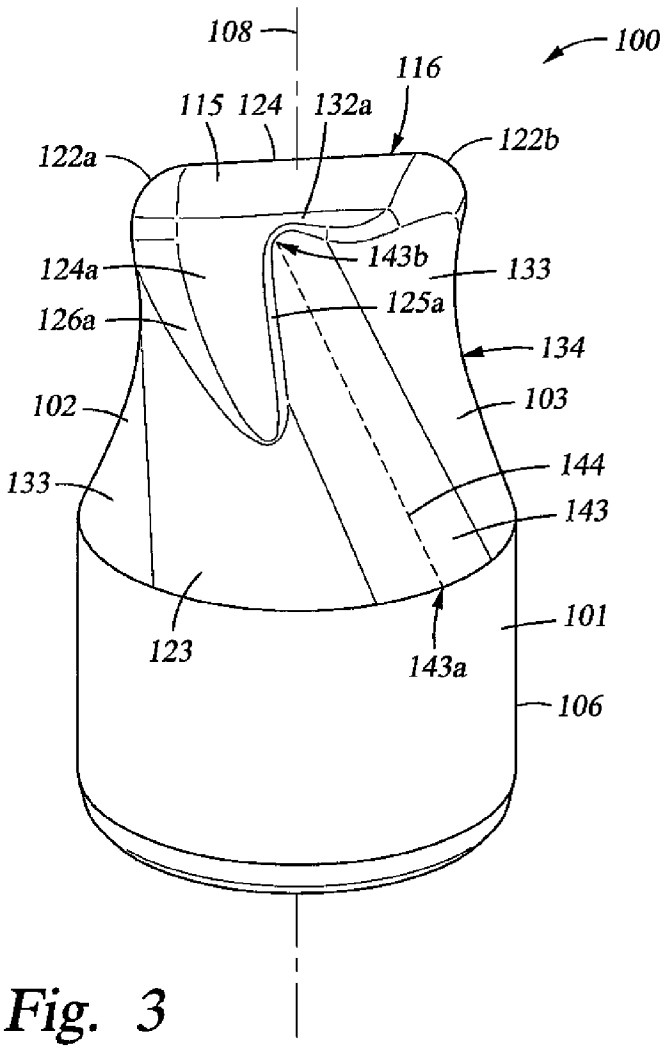
FIG. 3 is a perspective view of an embodiment of a cutter element having particular application in a rolling cone bit such as that shown in FIGS. 1 and 2.
Figure 5:
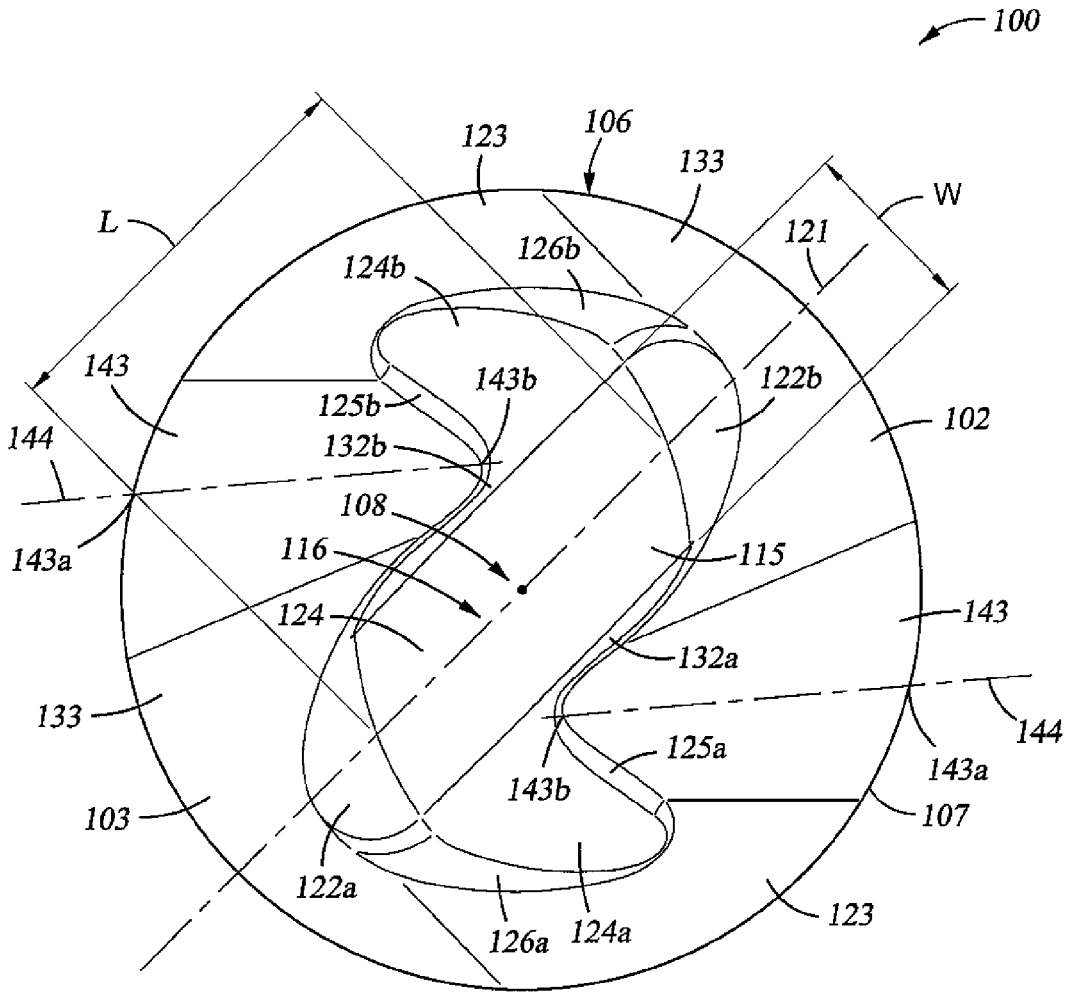
FIG. 5 is a top view of the cutter element shown in FIG. 3.

A cutter element 100 is shown in FIGS. 3-5 and is believed to have particular utility when employed as an inner row cutter element, such as in inner rows 81*a* or 82*a* shown in FIGS. 1 and 2 above. However, cutter element 100 may also be employed in other rows and other regions on the cone cutter, such as in heel row 60*a* and gage rows 70*a*, 70*b* shown in FIGS. 1 and 2.

Referring now to FIGS. 3-5, cutter element or insert 100 is shown to include a base portion 101 and a cutting portion 102 extending therefrom. Cutting portion 102 includes a cutting surface 103 extending from a reference plane of intersection 104 that divides base 101 and cutting portion 102 (FIG. 4). In this embodiment, base portion 101 is generally cylindrical, having diameter 105, central axis 108, and an outer surface 106 defining an outer circular profile or footprint 107 of the insert (FIG. 5). As best shown in FIG. 4, base portion 101 has a height 109, and cutting portion 102 extends from base portion 101 so as to have an extension height 110. Collectively, base 101 and cutting portion 102 define the insert's overall height 111. Base portion 101 may be formed in a variety of shapes other than cylindrical. As conventional in the art, base portion 101 is preferably retained within a rolling cone cutter by interference fit, or by other means, such as brazing or welding, such that cutting portion 102 and cutting surface 103 extend beyond the cone steel. Once mounted, the extension height 110 of the cutter element 100 is generally the distance from the cone surface to the outermost point or portion of cutting surface 103 as measured perpendicular to the cone surface and generally parallel to the insert's axis 108.

Referring still to FIGS. 3-5, cutting portion 102 comprises a pair of generally opposed flanking surfaces 123 and a pair of generally opposed crest end surfaces 133 that each taper or incline towards one another from base portion 101, and generally meet to form a elongate chisel crest 115. As used herein, the term "elongate" may be used to describe an insert structure or feature (e.g., a crest) whose length is greater than its width. In addition, a pair of generally opposed flutes 143 are included in cutting surface 103 of cutting portion 102. In this embodiment, each flute 143 is circumferentially positioned between one of the flanking surfaces 123 and one of the crest end surfaces 122*a, b*. Flutes 143 are grooved or trench-like features having surfaces that are generally recessed or concave relative to the remainder of cutting surface 103 (e.g., crest end surfaces 122*a, b*, flanking surfaces 123, crest 115, etc.). As best seen in FIGS. 3 and 4, since flanking surfaces 123 and a pair of generally opposed crest end surfaces 133 that each taper or incline towards one another from base portion 101, cutting portion 102 generally narrows as it extends from base portion 101 towards elongate chisel crest 115 in front profile and side profile.

Flutes 143 each extend along a flute median line 144 between a flute base end 143*a* and a flute crest end 143*b*. In this embodiment, flutes 143 are non-linear. In particular, in the embodiment shown in FIGS. 3-5, flutes 143 generally spiral in a clockwise direction as they extend from base portion 101 towards crest 115. Since flutes 143 spiral as they extend toward crest 115, flutes 143 may also be referred to herein as "spiral flutes." Still further, in this embodiment, spiral flutes 143 spiral or twist about axis 108 between base portion 101 and crest 115. In other words, axis 108 also serves as the central axis of rotation for spiral flutes 143. In other embodiments, the flutes (e.g., spiral flutes 143) may spiral clockwise and/or spiral about an axis that is offset from axis 108. In still other embodiments, the flutes (e.g., flutes 143) may not extend completely to the base portion or the crest. For instance, in one embodiment, the flutes extend begin on the cutting surface intermediate the base portion and the crest, and extend upward to the crest.

Figure 5A:
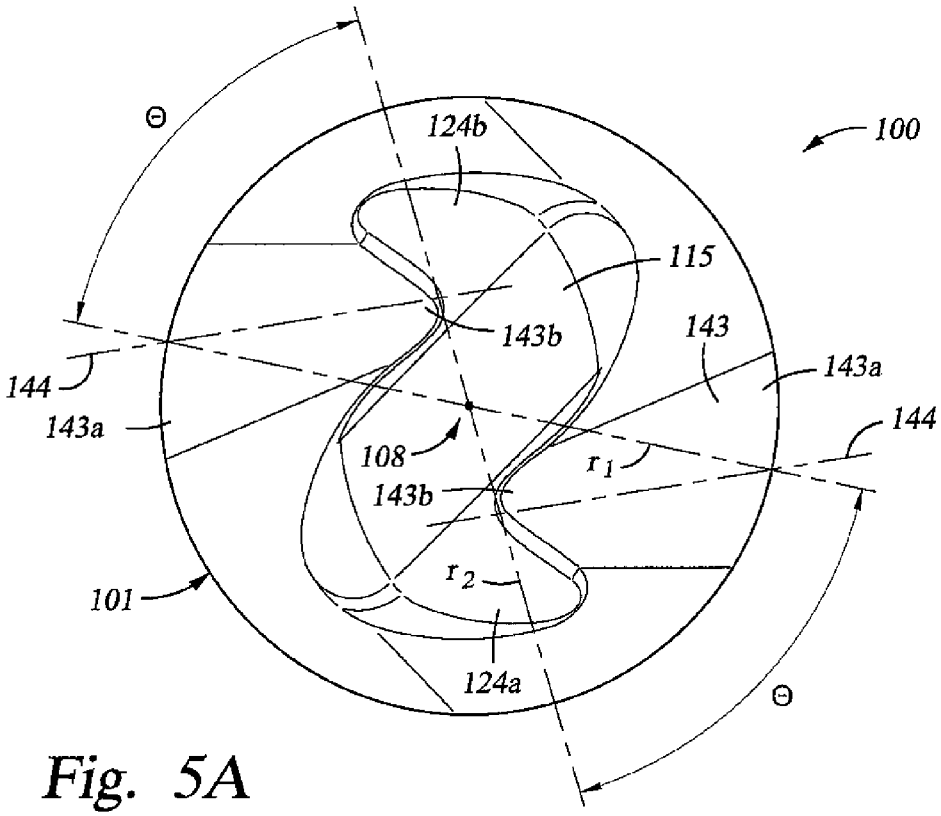
FIG. 5A is another top view of the cutter element shown in FIG. 3.

In this embodiment, spiral flutes 143 are uniformly circumferentially spaced about 180° apart. In such configurations, the pair of spiral flutes 143 may be described as a double helix whose individual helices (i.e., spiral flutes 143) generally tapers towards one another as they approach crest 115. Referring briefly to FIG. 5A, each spiral flute 143 spirals through a twist or spiral angle θ as it extends from base portion 101 to crest 115. Thus, as used herein, the phrases "twist angle" and "spiral angle" may be used to refer to the angle through which a flute spirals or rotates between its end proximal or at the base portion and its end at the crest of an insert or cutting element. In general, spiral angle θ is the angular measure between a pair of radii that extend from axis 108 through flute median line 144 at each of flute ends 143*a, b*. For instance, for one of the spiral flutes 143 shown in FIG. 5A, a first radius $r_1$ extends from axis 108 to flute median line 144 at first flute end 143*a*, and a second radius $r_2$ extends from axis 108 to flute median line 144 at second flute end 143*b*. The spiral angle θ of flute 143 is the angle formed between first radius $r_1$ and second radius $r_2$. Spiral angle θ is preferably between 30° and 180°, and more preferably between 30° and 90°. In the exemplary embodiment shown in FIGS. 3-5 and 5A, spiral angle θ is about 60°. In this embodiment, both spiral flutes 143 rotate through the same spiral angle θ, however, in other embodiments, one or more flutes may spiral through different spiral angles. Although flutes 143 are described herein as spiraling about axis 108 as each extends from base portion 101 to crest 115, in other embodiments, the flutes provided in the cutting surface (e.g., flutes 143) may take other shapes and configurations other than spirals. For instance, in one embodiment, the flutes extend linearly between the base portion and the crest.

Referring again to FIGS. 3-5, flanking surfaces 123, crest end surfaces 133, spiral flutes 143, crest corners 122*a, b*, and crest 115 are preferably blended to form a continuously contoured cutting surface 103. Specifically, in this embodiment, relatively smooth transition surfaces are provided between flanking surfaces 123, crest end surfaces 133, spiral flutes 143, crest corners 122*a, b*, and crest 115 such that cutting surface 103 is continuously contoured. As used herein, the term "continuously contoured" may be used to describe surfaces that are smoothly curved so as to be free of sharp edges and transitions having small radii (0.08 in. or less) as have conventionally been used to break sharp edges or round off transitions between adjacent distinct surfaces.

Referring to the perspective and side views of FIGS. 3 and 4, respectively, flanking surfaces 123, crest end surfaces 133, and crest 115 define a front periphery or profile 134 of insert 100 (FIG. 3); while crest end surfaces 133, spiral flutes 143, and crest 115 define a side periphery or profile 135 of insert 100 (FIG. 4). It is to be understood that in general, the term "profile" may be used to refer to the shape and geometry of the outer periphery of a object (e.g., insert 100). Contrary to most conventional chisel crest inserts, as seen in front and side profiles 134, 135, respectively, flanking surfaces 123, crest end surfaces 133, and spiral flutes 143 are not straight in profile view in the region between base portion 101 and crest 115. Rather, in this embodiment, flanking surfaces 123, crest end surfaces 133, and spiral flutes 143 are slightly concave between base portion 101 and crest 115.

Elongate chisel crest 115 extends between crest ends or corners 122*a, b* and lateral sides 132*a, b*, and comprises a peaked ridge 124, and an apex 116. Thus, crest ends 122*a, b* generally define the length L of crest 115, and crest lateral sides 132*a, b* generally define the width W of crest 115. In this embodiment, the width of crest 115 between crest lateral sides 132*a, b* is substantially constant along crest median line 121 in top view (FIG. 5). In other words, in this embodiment, crest lateral sides 132*a, b* are substantially parallel in top view.

Further, in this embodiment, crest 115 and peaked ridge 124 extend substantially linearly between crest corners 122*a, b* along a crest median line 121 as best shown in the top view of FIG. 5. For descriptive purposes, a crest (e.g., crest 115) that extends substantially linearly along a straight median line in top view may be referred to herein as a "straight crest." In this embodiment, crest ends 122*a, b* are generally spherical and of similar size. However, in other embodiments, the crest ends need not be spherical and may not be of similar size.

Apex 116 represents the uppermost portion of cutting surface 103 and crest 115 at extension height 110. Thus, as used herein, the term "apex" may be used to refer to the point, line, or surface of an insert disposed at the extension height of the insert. In this embodiment, crest 115 is substantially flat between crest ends 122*a, b* in front profile, thus, the uppermost surface of peaked ridge 124 extends to extension height 110. In other embodiments, the crest (e.g., crest 115) may be curved (e.g., convex, concave, etc.) between its crest ends in front profile view.

Referring now to side profile 135 (FIG. 4), in this embodiment, crest 115 is also curved between lateral sides 132*a, b*. Specifically, crest 115 is convex or bowed outward between lateral sides 132*a, b*, thereby forming peaked ridge 124. Since crest 115 is convex as seen in side profile 135 (FIG. 4), when insert 100 engages the uncut formation, peaked ridge 124, at least initially, presents a reduced surface area region or projection that contacts the formation. Consequently, peaked ridge 124 substantially at apex 116 offers the potential to enhance formation penetration of insert 100 since the weight applied to the formation through insert 100 is concentrated, at least initially, on the relatively small surface area of peaked ridge 124.

Referring again to FIGS. 3-5, a pair of crest transition surfaces 124*a, b* generally sweep radially outward and downward from crest 115. More specifically crest transition surfaces 124*a, b* extend generally perpendicularly from opposite lateral sides 132*a, b* of crest 115 proximal opposite crest ends 122*a, b*. Further, first crest transition surface 124*a* extends generally perpendicularly from crest lateral side 132*a* proximal crest end 122*a* towards base portion 101, while second crest transition surface 124*b* extends generally perpendicularly from crest lateral side 132*b* proximal crest end 122*b* generally towards base portion 101.

Each crest transition surface 124*a, b* is bounded by crest lateral side 132*a, b*, a first side or boundary 125*a, b*, and a second side or boundary 126*a, b*, respectively. For instance, crest transition surface 124*a* is bordered by crest lateral side 132*a*, first side 125*a* extending generally perpendicularly from crest lateral side 132*a*, and second side 126*a* extending from crest end 122*a* towards and intersecting first side 125*a*. Likewise, crest transition surface 124*b* is bordered by crest lateral side 132*b*, first side 125*b* extending generally perpendicularly from crest lateral side 132*ba*, and second side 126*b* extending from crest end 122*b* towards and intersecting first side 125*b*. In this embodiment, crest transition surfaces 124*a, b* do not extend completely to base portion 101, but rather, flanking surfaces 123 are provided at least partially between crest transition surfaces 124*a, b* and base portion 101.

Referring still to FIGS. 3-5, flanking surfaces 123 and crest end surfaces 133 generally extend from base portion 101 to crest transition surfaces 124*a, b* and crest ends 122*a, b*, respectively. In addition, spiral flutes 143 generally extend from base portion 101 to chisel crest 115 and spiral therebetween as previously described. In particular, each spiral flute 143 generally intersects the junction of crest 115 and crest transition surface 124*a, b*. One of the spiral flutes 143 intersects first side 125*a* of crest transition surface 124*a* and crest lateral side 132*a* of crest 115, while the other spiral flute intersects first side 135*b* of crest transition surface 124*b* and crest lateral side 132*b* of crest 115. As best shown in FIGS. 3 and 5, spiral flutes 143 spiral about axis 108 as they extend between base portion 101 and crest 115 as previously described. In addition, crest transition surfaces also have a sweeping or spiraled configuration generally leading its associated spiral flute 143.

As previously described, cutting surface 103 is preferably continuously contoured. In particular, cutting surface 103 includes transition surfaces between flanking surfaces 123, crest end surfaces 133, spiral flutes 143, crest corners 122*a, b*, and crest 115 to reduce detrimental stresses. Although certain reference or contour lines are shown in FIGS. 3-5 to represent general transitions between one surface and another, it should be understood that the lines do not represent sharp transitions. Instead, all surfaces are preferably blended together to form the preferred continuously contoured surface and cutting profiles that are free from abrupt changes in radius. By eliminating small radii along cutting surface 103, detrimental stresses in cutting surface 103 are reduced, leading to a more durable and longer lasting cutter element.

Figure 6:
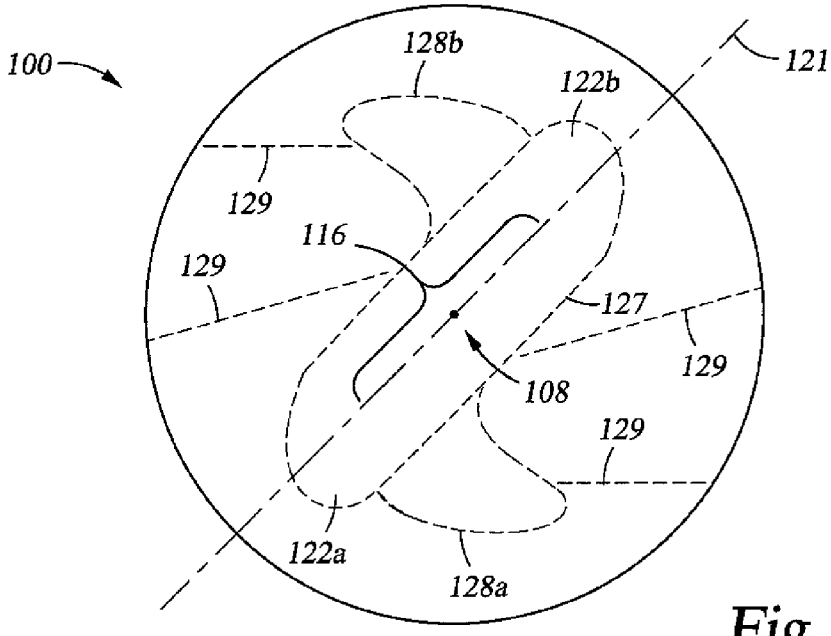
FIG. 6 is a schematic top view of the cutter element shown in FIGS. 3-5.

Referring now to FIG. 6, a top view of insert 100 like that shown in FIG. 5 is shown, however, in FIG. 6, dashed lines 127, 128*a, b*, and 129 schematically represents what is referred to herein as the top profiles of crest 115, crest transition surfaces 124*a, b*, and spiral flutes 143, respectively. In particular, dashed line 127 represents the general elongate shape corresponding to the top profile of crest 115, dashed lines 128*a, b* represents the general shape corresponding to the top profile of crest transition surfaces 124*a, b*, and dashed line 129 represents the general shape corresponding to the top profile of spiral flutes 143. In this embodiment, the location of apex 116 is denoted by a line substantially at extension height 110.

As illustrated by line 127, in this embodiment, elongate chisel crest 115 is generally a straight chisel crest as previously described. In addition, apex 116 is generally centered on crest 115 and extends linearly along crest median line 121 between crest ends 122*a, b*. Thus, apex 116 is equidistant from crest ends 122. Further, in this embodiment, apex 116 and crest 115 are centered relative to insert axis 108. In other words, insert axis 108 intersects apex 116 and passes through the center of crest 115. Thus, crest 115 may be described as having zero offset from the insert axis. As will be explained in more detail below, in other embodiments, the apex may be positioned closer to one of the crest ends (i.e., not centered about the crest ends), and further, the crest or apex may be offset from the insert axis.

As illustrated by lines 128*a, b*, crest transition surfaces 124*a, b*, are similarly sized and shaped, each being an inverted mirror image of the other. In particular, crest transition surfaces 124*a, b* may each generally be described as "dorsal fin" shaped, being somewhat triangular with slightly curved sides and rounded corners. Crest transition surface 124*a* extends from crest 115 proximal crest end 122*a* generally perpendicularly to crest 115 and crest median line 121, and similarly, crest transition surface 124*b* extends from crest 115 proximal the other crest end 122*b* generally perpendicularly to crest 115 and crest median line 121. It should be appreciated that crest transition surfaces 124*a, b* extend from opposite sides of crest 115, and further, crest transition surfaces 124*a, b* extend in opposite directions. Consequently, crest 115 and crest transition surfaces 124*a, b* collectively form a generally S-shape figure in top schematic view. Moreover, in this embodiment, crest transition surfaces 124*a, b* are equidistant from axis 108.

As previously described, spiral flutes 143 and crest transition surfaces 124*a, b* generally spiral about axis 108. As a result, cutting portion 102 has a geometry that may be described as twisted about axis 108 as would be the case if the insert base was held firmly to resist rotation while crest 115 was rotated about axis 108 relative to base portion 101.

Figure 7:
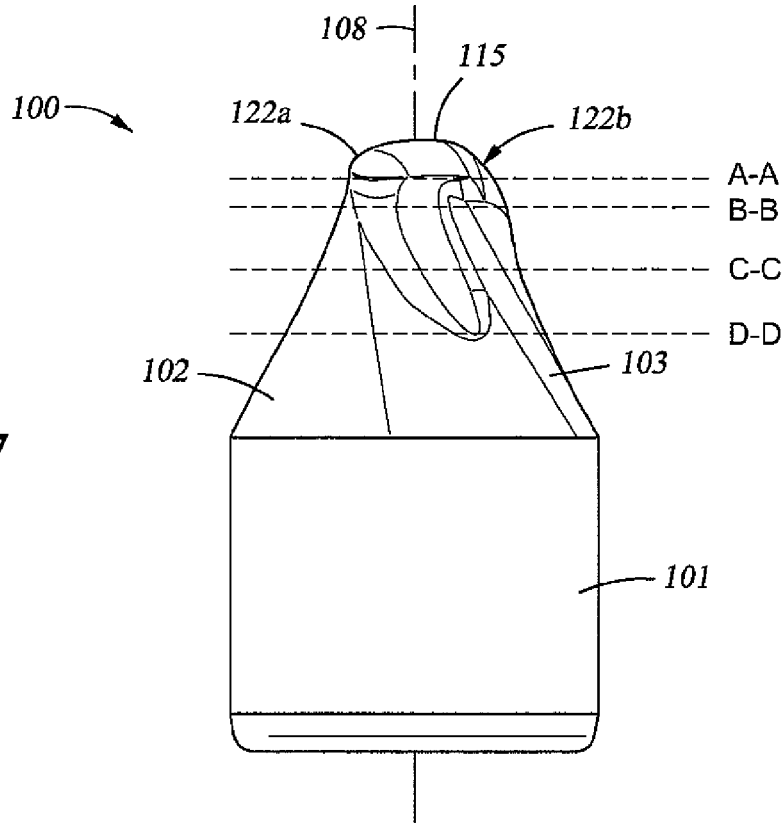
FIG. 7 is a side elevation view of the cutter element shown in FIG. 3 illustrating three cross-sectional planes.
Figure 8:
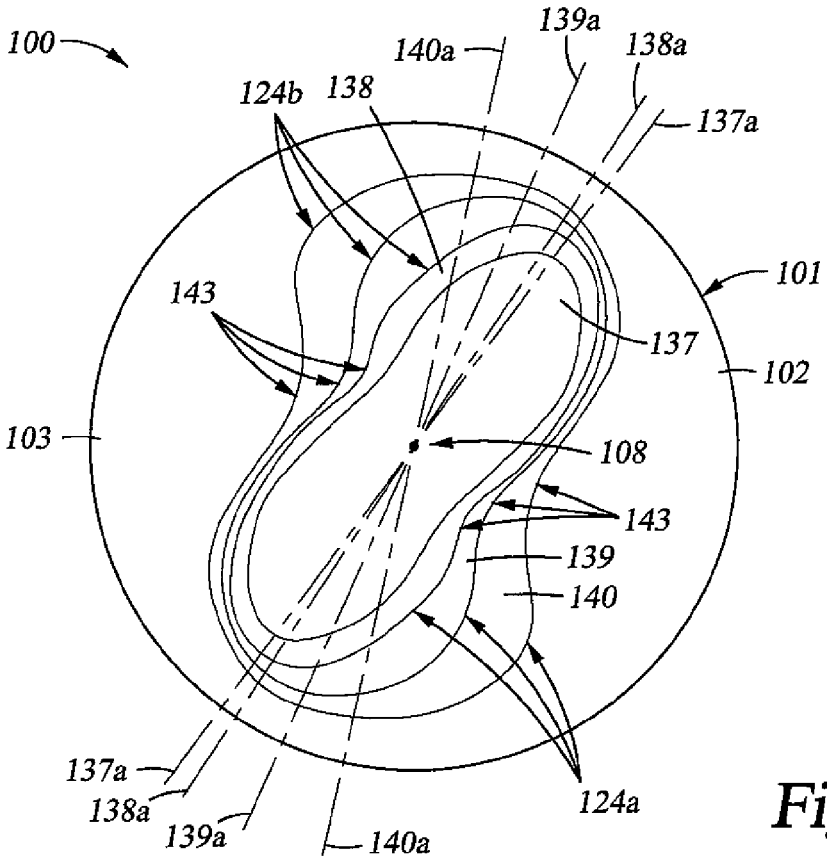
FIG. 8 is a schematic top view of three cross-sections of the cutter element of FIG. 6 taken at planes A-A, B-B, and C-C.

Referring now to FIGS. 7 and 8, the twisted geometry of cutting portion 102, resulting from the spiraling crest transition surfaces 124*a, b* and spiral flutes 143 previously described, may best be illustrated by comparing select cross-sections of cutting portion 102 taken perpendicular to axis 108. For instance, FIG. 8 schematically illustrates the top profile or shape of cross-sections of cutting portion 102 taken at planes A-A, B-B, C-C, and D-D passes through cutting portion 102 perpendicular to axis 108 (FIG. 7). Plane A-A is positioned at about 90% of extension height 110, plane B-B is positioned at about 80% of extension height 110, plane C-C is positioned at about 60% of extension height 110, and plane D-D is positioned at about 40% of the extension height 110.

Referring specifically to FIG. 8, cross-sections 137, 138, 139, and 140 schematically represent the cross-sections of cutting portion 102 taken at planes A-A, B-B, C-C, and D-D, respectively. For purposes of clarity and further explanation, cross-section 137, 138, 139, and 140 are shown overlaid on one another in FIG. 8. Cross-sections 137, 138, 139, and 140 each include a longitudinal sectional axis 137*a*, 138*a*, 139*a*, and 140*a*, respectively. In this embodiment, since crest transition surfaces 124*a, b* and spiral flutes 143 each spiral about axis 108, each sectional axis 137*a*, 138*a*, 139*a*, and 140*a* passes through axis 108.

Referring now to FIG. 8, the twisted geometry of cutting portion 102 is best illustrated by comparing cross-sections 137, 138, 139, and 140 and their respective longitudinal axes 137*a*, 138*a*, 139*a*, and 140*a*. Moving from base portion 101 toward crest 115, each successive cross-section (e.g., cross-sections 137, 138, 139, and 140) is rotated generally about axis 108 relative to the previous cross-section. For instance, cross-section 139 is oriented such that its axis 139*a* is rotated clockwise relative to cross-section 140 and its axis 140*a*. Similarly, cross-section 138 is oriented such that its axis 138*a* is rotated clockwise relative to cross-section 139 and its axis 139*a*, cross-section 138 is oriented such that its axis 138*a* is rotated clockwise relative to cross-section 139 and its axis 139*a*, and so on. In other embodiments, successive cross-sections moving from the base portion to the crest may rotate counter-clockwise. The utility of employing this twisted or rotated cutting portion 102 will be explained in more detail below.

Referring still to FIG. 8, comparing the outer profiles of successive cross-sections (e.g., cross-sections 137, 138, 139, and 140), the bulging or convex geometry of crest transition surfaces 124*a, b*, and the concave geometry of spiral flutes 143 may also be seen. In the top view, the lower the cross-section, the more crest transition surfaces 124*a, b* extend outwards towards outer radial footprint 107 relative to the remainder of cutting surface 103. Consequently, crest transition surfaces 124*a, b* may be described as convex relative to the remainder of cutting surface 103 (e.g., spiral flutes 143, crest end surfaces 133, flanking surfaces 123, etc.). However, spiral flutes 143 adjacent crest transition surfaces 124*a, b* are generally concave relative to the remainder of cutting surface 103 as previously described.

Figure 9:
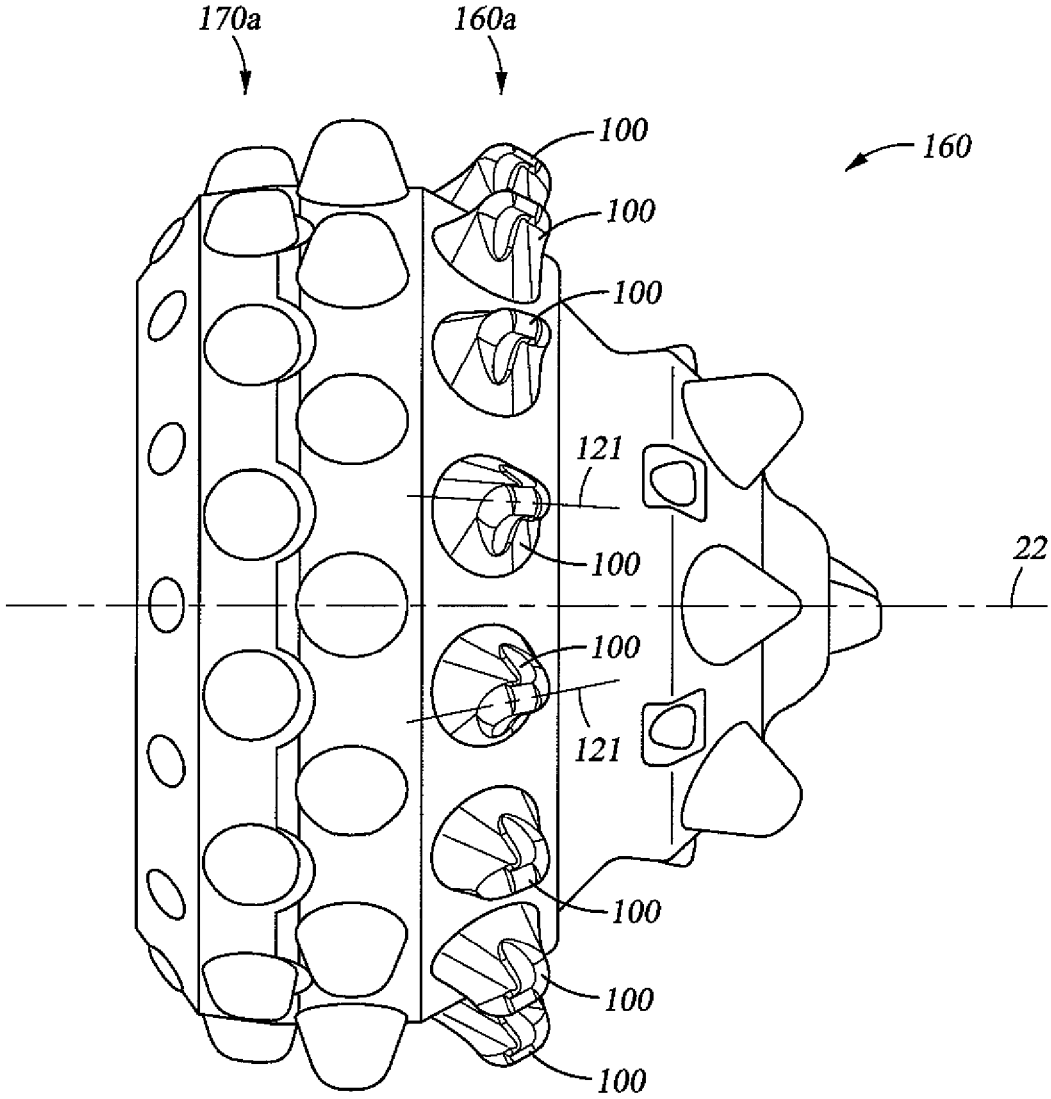
FIG. 9 is a perspective view of a portion of a rolling cone cutter having the cutter element of FIGS. 3-5 mounted therein.

Referring now to FIG. 9, insert 100 described above is shown mounted in a rolling cone cutter 160 as may be employed, for example, in bit 10 described above with reference to FIGS. 1 and 2, with cone cutter 160 substituted for any of the cones 1-3 previously described. As shown, cone cutter 160 includes a plurality of inserts 100 disposed in a circumferential inner row 160*a*. In this embodiment, inserts 100 are all oriented such that a projection of crest median line 121 is aligned with cone axis 22. Inserts 100 may be positioned in rows of cone cutter 160 in addition to or other than inner row 160*a*, such as in gage row 170*a*. Likewise, inserts 100 may be mounted in other orientations, such as in an orientation where a projection of the crest median line 121 of one or more inserts 100 is skewed relative to the cone axis.

As understood by those in the art, the phenomenon by which formation material is removed by the impacts of cutter elements is extremely complex. The geometry and orientation of the cutter elements, the design of the rolling cone cutters, the type of formation being drilled, as well as other factors, all play a role in how the formation material is removed and the rate that the material is removed (i.e., ROP).

Depending upon their location in the rolling cone cutter, cutter elements have different cutting trajectories as the cone rotates in the borehole. Cutter elements in certain locations of the cone cutter have more than one cutting mode. In addition to a scraping or gouging motion, some cutter elements include a twisting motion as they enter into and then separate from the formation. As such, the cutter elements 100 may be oriented to optimize cutting that takes place as the cutter element impacts, scrapes, and twists against the formation. Furthermore, as mentioned above, the type of formation material dramatically impacts a given bit's ROP. In relatively brittle formations, a given impact by a particular cutter element may remove more rock material than it would in a less brittle or a plastic formation.

The impact of a cutter element with the borehole bottom will typically remove a first volume of formation material (via plastic deformation), and in addition, will tend to cause cracks to form in the formation immediately below the material that has been removed (via brittle fracture). These cracks, in turn, allow for the easier removal of the now-fractured material by the impact from other cutter elements on the bit that subsequently impact the formation. Without being held to this or any other particular theory, it is believed that an insert such as insert 100 having an elongate chisel crest 115, generally convex sweeping crest transition surfaces 124*a, b*, and spiral flutes 143, as described above, will enhance formation removal by propagating cracks further into the uncut formation than would be the case for a conventional chisel crested insert of similar design and size lacking crest transition surfaces 124*a, b* and spiral flutes 143. It is anticipated that providing elongate chisel crest 115 with its relatively sharp geometry and small cross-sectional area (at apex 116) will provide the cutter element with the ability to penetrate deeply without the requirement of adding substantial additional weight-on-bit to achieve that penetration similar to a conventional chisel crested insert. Peaked ridge 124 leads insert 100 into the formation and initiates the insert's penetration. As a result, insert 100 offers the potential for comparable formation removal by plastic deformation as a conventional chisel crested insert. However, as elongate chisel crest 115 penetrates deeper into the formation, it is anticipated that crest transition surfaces 124*a, b* and spiral flutes 143, as previously described, will enhance the forces and moments acting on the formation as compared to those conventional chisel crests that do not include flutes or crest transition surfaces. As a result, it is believed that the insert 100 will create deeper cracks into a localized area, thereby offering the potential for increased formation removal via brittle fracture, and enhanced formation removal by the cutter elements that follow thereafter.

Figure 10:
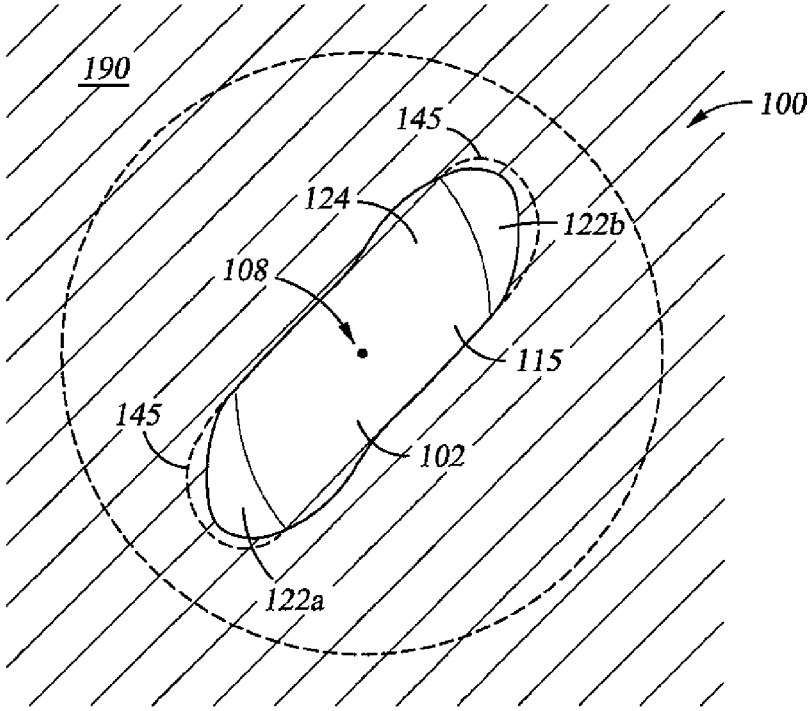
FIG. 10 is a schematic bottom view of the cutting portion of the cutter element shown in FIGS. 3-6 initially contacting and slightly penetrating an earthen formation.
Figure 11:
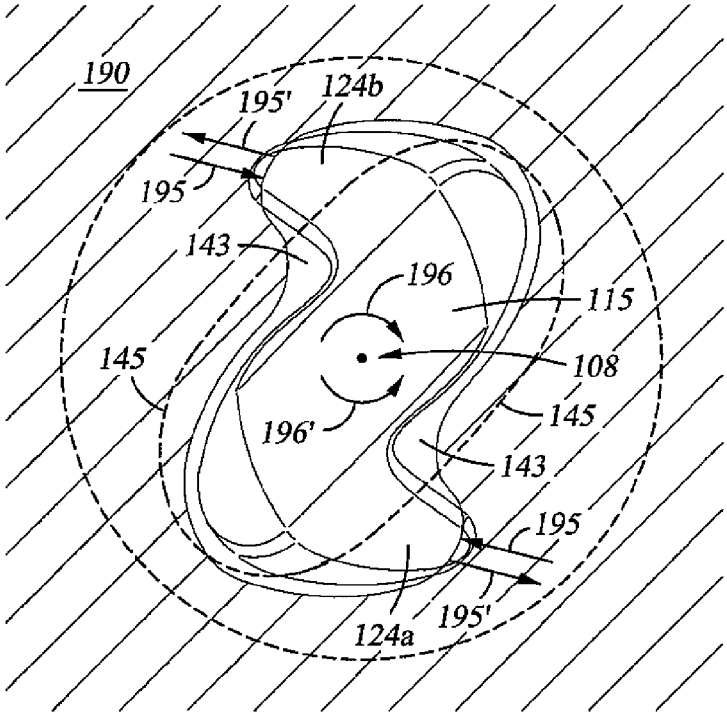
FIG. 11 are schematic bottom views of the cutting portion of the cutter element shown in FIGS. 3-6 penetrating the formation to selected depths.

Referring now to FIGS. 10 and 11, schematic illustrations of insert 100 penetrating a formation 190 to selected depths are shown. In particular, FIGS. 10 and 11 illustrate insert 100 penetrating formation 190 as viewed from within formation 190 at the bottom of the borehole looking upward. The portion of insert 100 that has not yet penetrated the formation is partially shown with hidden (dashed) lines. For comparison purposes, the portion of a conventional chisel-crested insert of similar size as insert 100 that penetrates the formation at the selected depths is schematically shown with a dashed line 145.

Referring specifically to FIG. 10, cutting portion 102 of insert 100 has just engaged formation 190 and is slightly penetrates formation 190. In this particular embodiment, crest 115 has penetrated formation 190 up to a depth of about 10% of extension height 110. Apex 116 of linear peaked ridge 124 positioned at extension height 110 is generally the first portion of insert 100 to penetrate the formation. At the initial stages of penetration into formation 190, crest 115 predominately engages the formation. In other words, during initial contact and penetration into formation 190 crest transition surfaces 124*a, b* and spiral flutes 143 have not yet engaged the formation. Comparing dashed line 145 with insert 100, elongate chisel crest 115 presents a cutting structure and surface to the formation similar to that of a conventional chisel-crested insert. As a result, it is believed that elongate chisel crest 115 of insert 100 will, at least initially, provide similar plastic deformation and volumetric formation removal at a given WOB as a similarly sized conventional chisel-crested insert. However, unlike a conventional chisel-crested inserts, embodiments of insert 100 also include crest transition surfaces 124*a, b* and spiral flutes 143 that engage the formation as insert 100 penetrates further into formation 190.

Referring now to FIG. 11, cutting portion 102 of insert 100 has penetrated formation 190 up to a depth of about 50% of extension height 110. Crest 115 has fully penetrated formation 190, and further, each crest transition surface 124*a, b* and spiral flutes 143 have partially penetrated the formation. As insert 100 penetrates the formation, crest transitions surfaces 124*a, b* and spiral flutes 143 present a cutting structure and surface to the formation that differs from a conventional chisel-crested insert schematically represented by dashed line 145. It should be appreciated that the differences in the geometry of the penetrating portion of insert 100 as compared to a conventional chisel-crested insert become more pronounced the deeper the penetration into formation 190. Specifically, comparing dashed line 145 with the penetrating portion of insert 100, dashed line 145 has the typical race-track shape symmetric about the median line of its chisel crest. However, the penetrating portion of insert 100 does not have the traditional race-track shape, but rather, is S-shaped, and further includes a twisted or spiral flutes 143. Consequently, insert 100 imposes different forces and moments to formation 190 than a conventional chisel-shaped insert of similar size.

Referring still to FIG. 11, as a conventional chisel-crested insert penetrates the formation in a direction generally parallel to the insert's axis, the symmetric race-track shaped cutting portion tends to apply substantially uniform and balanced impact forces to the formation. As used herein, the term "balanced" may be used to describe forces that do not result in torques or moments about an insert's axis. To the contrary, as cutting portion 102 of insert 100 penetrates the formation generally parallel to axis 108, it is believed that formation 190 will impose greater forces on crest transition surfaces 124*a, b*, which extend further into the formation, than spiral flutes 143, resulting in net unbalanced forces 195 acting on insert 100. Without being limited by this or any particular theory, the spiraled geometry of spiral flutes 143 tends to further increase unbalanced forces 195 as insert 100 penetrates deeper into the formation. Unbalanced forces 195 do not pass through axis 108, or the center or mass of insert 100, and thus, result in a moment 196 about axis 108 that seeks to rotate insert 100 about axis 108 in the direction of moment 196. However, insert 100 is rigidly secured within a mating socket in a rolling cone such as cone 1 shown in FIGS. 1 and 2, and restricted from rotation. As a result, equal and opposite reactive forces 195' and moments 196' are generated at the interface of insert 100 and the rolling cone to which it is secured, and translated through insert 100 to formation 190. It is believed that reactive forces 195' and moment 196', which increase as depth of penetration increases, will enhance fracture formation in the localized area, and hence, increase the potential for brittle fractures as compared to a conventional chisel-crested insert of similar size.

Figure 13:
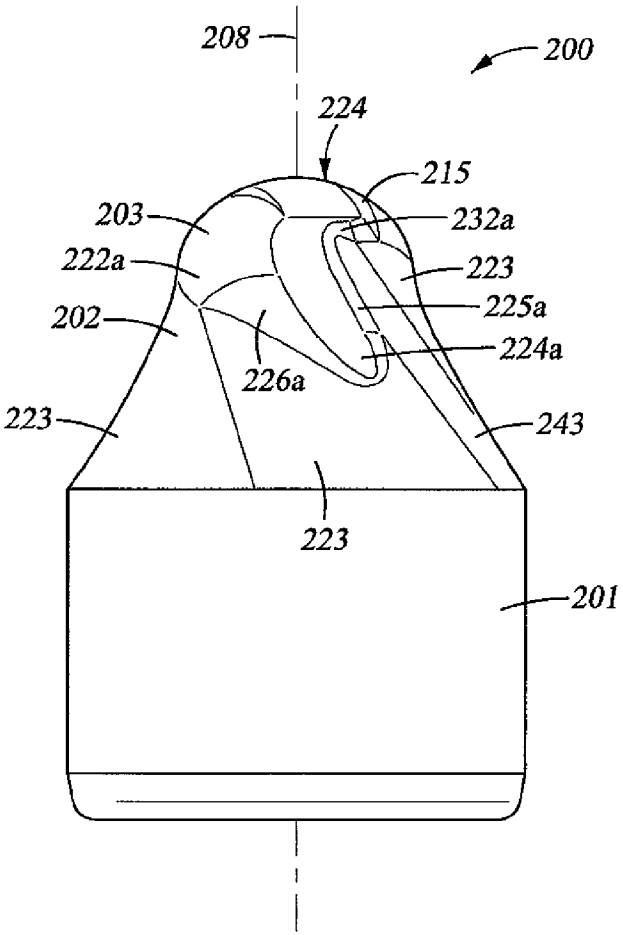
FIG. 13 is a side elevation view of the cutter element shown in FIG. 3.
Figure 12:
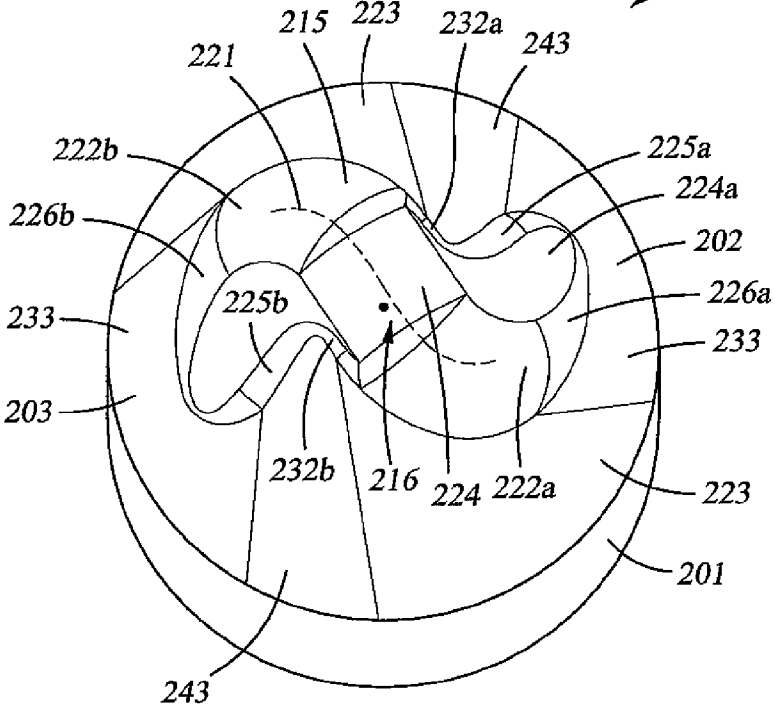
FIG. 12 is a perspective view of an embodiment of a cutter element having particular application in a rolling cone bit such as that shown in FIGS. 1 and 2.
Figure 14:
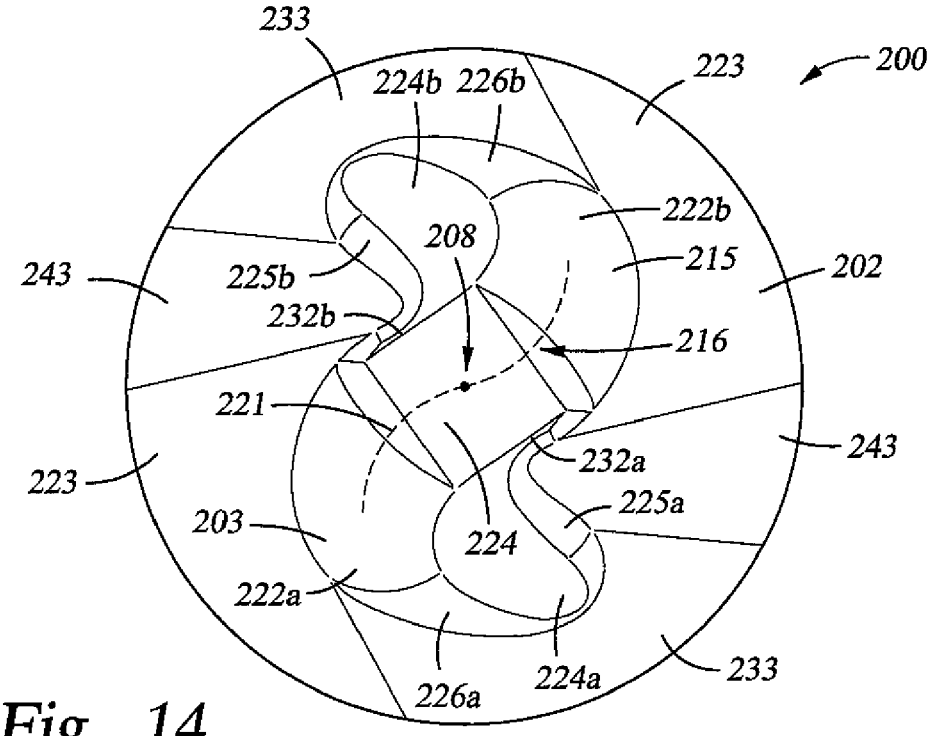
FIG. 14 is a top view of the cutter element shown in FIG. 3.

A cutter element 200 is shown in FIGS. 12-14 and is believed to have particular utility when employed as an inner row cutter element, such as in inner rows 81*a* or 82*a* shown in FIGS. 1 and 2 above. However, cutter element 200 may also be employed in other rows and other regions on the cone cutter, such as in heel row 60*a* and gage rows 70*a*, 70*b* shown in FIGS. 1 and 2.

Referring now to FIGS. 12-14, a cutter element or insert 200 is shown to include a cutting portion 202 including a curved elongate chisel crest 215 extending along an arcuate crest median line 221. More specifically, insert 200 includes a base portion 201, substantially identical to base 101 previously described, and a cutting portion 202 extending from base 201 and having a cutting surface 203 extending to an extension height 210. Cutting portion 201 is similar to cutting portion 102 of insert 100 previously described, the major difference being that insert 200 includes curved elongate chisel crest 215, while insert 100 includes a substantially straight elongate chisel crest 115. Cutting surface 203 is preferably continuously contoured. Base portion 201 has a central axis 208.

In still more detail, cutting portion 202 of cutting element 200 comprises a pair of opposed flanking surfaces 223, a pair of opposed crest end surfaces 233, and a pair of opposed spiral flutes 243 that each generally taper or incline towards each other and generally meet to form a elongate chisel crest 215. Chisel crest 215 extends between crest ends or corners 222*a, b* and lateral sides 232*a, b*, and includes a peaked ridge 224 having an apex 216. In this embodiment, crest lateral sides 232*a, b* are substantially parallel in top view. However, lateral sides 232*a, b* and crest 215 are not straight, but rather, are curved in top view (FIG. 14). Specifically, crest 115 extends between crest corners 222*a, b* along crest median line 221. For descriptive purposes, a crest (e.g., crest 215) that extends along a curved or arcuate median line in top view may be referred to herein as a "curved crest." In the embodiment shown in FIGS. 12-14, unlike insert 100 having a straight crest 115 as previously described, insert 200 has a curved elongate chisel crest 215, and more specifically, has an S-shaped elongate chisel crest 215 as best seen in top view (FIG. 14).

In this embodiment, peaked ridge 224 is substantially flat between crest ends 222*a, b* in front profile, thus, the upper surface of peaked ridge 224 extends substantially to extension height 110. Further, as best shown in FIG. 13, in this embodiment, crest 215 is also curved between lateral sides 232*a, b*. Specifically, crest 215 is convex or bowed outward between lateral sides 232*a, b*, thereby forming peaked ridge 224.

Referring still to FIGS. 12-14, each spiral flute 243 is circumferentially positioned between one of the flanking surfaces 223 and one of the crest end surfaces 222*a, b*. More particularly, the pair of spiral flutes 243 are circumferentially spaced about 180° apart, each having substantially the same spiral angle. In this embodiment, the spiral angle of flutes 243 are about 60°. Spiral flutes 243 are generally recessed valleys in cutting surface 203.

Similar to insert 100 previously described, crest transition surfaces 224*a, b* of insert 200 generally extend away and downward from crest 215. Crest transition surfaces 224*a, b* extend from opposite lateral sides 232*a, b* of crest 215 proximal opposite crest ends 222*a, b*. Each crest transition surface 224*a, b* may be described as including a first side or boundary 225*a, b* extending generally radially from crest lateral side 232*a, b*, and a second side or boundary 226*a, b* extending from one of the crest ends 222*a, b* generally towards and intersecting first side 225*a, b*, respectively. Spiral flutes 243 extend from base portion 201 generally to the juncture of chisel crest 215 and crest transition surface 224*a, b*.

Similar to insert 100 previously described and unlike conventional chisel-shaped inserts, cutting portion 202 of insert 200 generally twists or rotates about axis 208. More specifically, spiral flutes 243 twist or rotate about axis 208 as they extend from base portion 201 towards crest 215. For similar reasons previously described with reference to insert 100, it is believed that spiral flutes 243, elongate chisel crest 215, and crest transitions surfaces 224*a, b* of insert 200 will offer the potential for enhanced formation removal as compared to a conventional chisel-crested insert. In particular, it is believed that spiral flutes 243, elongate chisel crest 215, and crest transitions surfaces 224*a, b* of insert 200 will enhance the creation of brittle fractures in the formation by imposing unbalanced forces and moments to the formation material in the localized region of insert 200.

Figure 15:
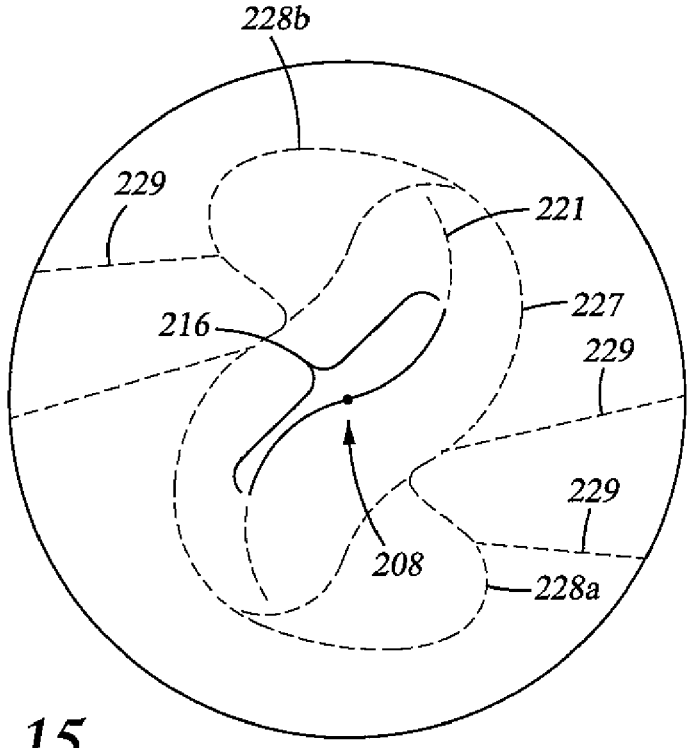
FIG. 15 is a schematic top view of the cutter element shown in FIGS. 12-14.

FIG. 15 represents top view of insert 200 similar to that of insert 100 shown in FIG. 6. Dashed line 227 schematically represents the top profile of elongate chisel crest 215, dashed lines 228*a, b* schematically represents the top profile of crest transition surfaces 224*a, b*, and dashed lines 229 schematically represent the top profile of spiral flutes 243. As shown in this embodiment, crest 215 is centered relative to axis 208, thus, having zero offset from axis 208. Further, apex 216 and crest median line 221 each intersect axis 208. Further, apex 116 is generally centered on crest 215 and extends linearly along crest median line 221 between crest ends 222*a, b*.

As illustrated by line 227, in this embodiment elongate chisel crest 215 is generally S-shaped, having a median line 221 and an apex 216 that are each slightly S-shaped. As illustrated by lines 228*a, b*, crest transition surfaces 224*a, b*, are similarly sized and shaped, each being an inverted mirror image of the other. Crest transition surface 224*a* extends from crest 215 proximal crest end 222*a* generally perpendicularly to crest 215 and crest median line 221, and similarly, crest transition surface 224*b* extends from crest 215 proximal the other crest end 222*b* generally perpendicularly to crest 215 and crest median line 221. It should be appreciated that crest transition surfaces 224*a, b* extend from opposite sides of crest 215, and further, crest transition surfaces 224*a, b* extend in opposite directions. Consequently, crest transition surfaces 224*a, b* generally extend or exaggerate the generally S-shape of crest 215 in top schematic view.

Figure 16:
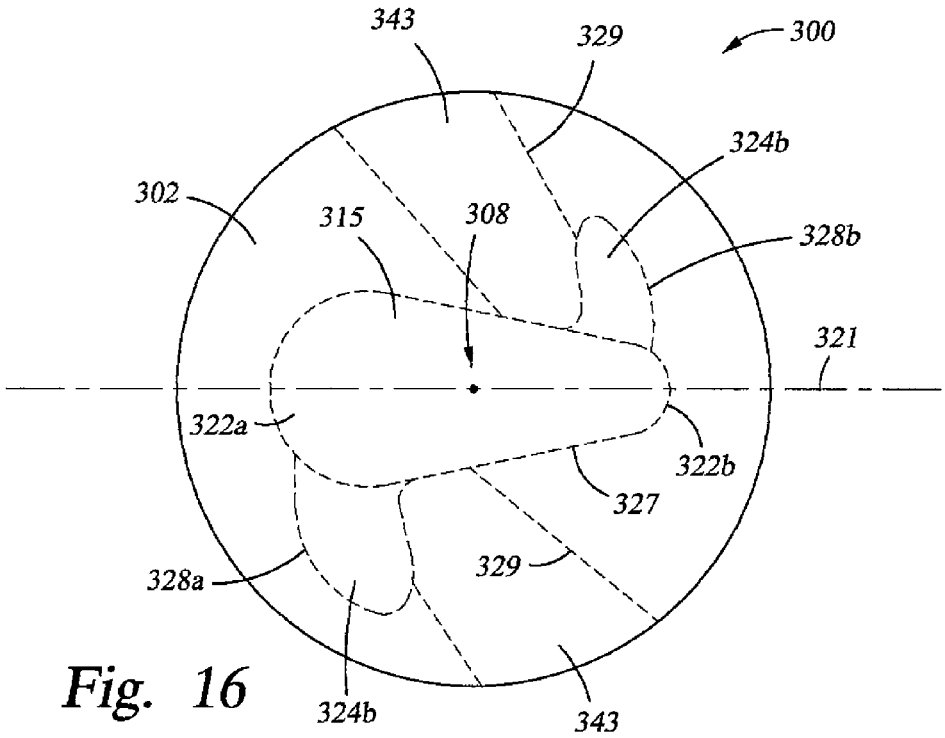
FIGS. 16-19 are schematic top views of alternative cutter elements having application in a rolling cone bit, such as that shown in FIGS. 1 and 2.

FIGS. 16-19 are similar to the views of FIGS. 6 and 15 and show, in schematic fashion, alternative cutter elements made in accordance with the principles previously disclosed. In particular, FIG. 16 shows that a cutter element 300 having a axis 308 and a cutting portion 302 including a straight elongate chisel crest 315 represented by a top profile 327, a pair of crest transition surfaces 324*a, b* represented by a top profile 328, and a pair spiral flutes 343 represented by a top profile 329. Similar to insert 100 previously described, crest 315 extends along a straight crest median line 321, spiral flutes 343 are circumferentially spaced about 180° apart, and crest transition surfaces 324*a, b* extend from opposite ends of opposite sides of crest 315 towards the base of insert 300. However, in this embodiment, the ends of crest 315 are not uniformly sized. In particular, crest 315 includes a first crest end 322*a* that is larger than a second crest end 322*b*. In this example, each crest end 322*a, b* is generally spherical with a radius at end 322*a* larger than the radius of end 322*b*. In certain formations, and in certain positions in a rolling cone cutter, it is desirable to have a crest end with a greater mass of insert material. For example, insert 300 may be employed in a gage row, such as row 80*a* shown in FIGS. 1 and 2, with insert 300 positioned such that end 322*a* is closest to the borehole sidewall than crest end 322*b*.

Figure 17:
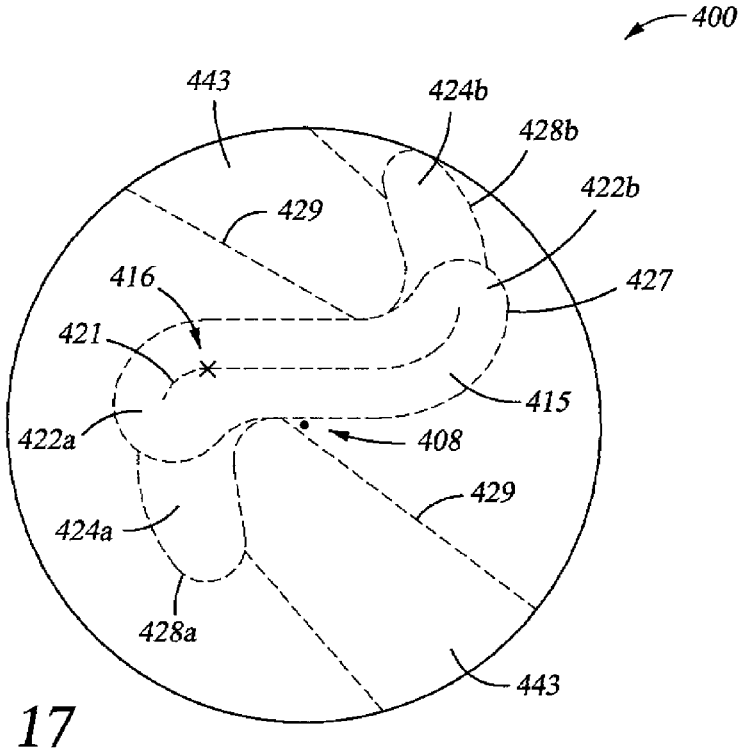

Disclosed in FIG. 17 is a cutter element 400 similar to insert 200 previously described. Insert 400 has an axis 408 and a cutting portion 402 including an S-shaped elongate chisel crest 415 represented by a top profile 427 and spiral flutes 443 represented by a top profile 429. Crest 415 extends along an S-shaped crest median line 421 generally between crest ends 422*a, b*. However, in this embodiment, crest 415 is offset from axis 408 (i.e., crest median line 421 does not intersect axis 408). Further, in this embodiment, elongate crest 415 has an apex 416 that is not equidistant from crest ends 422*a, b*. In this example, apex 416 is a point marked by the "X" that is positioned closer to crest end 422*a*. Spiral flutes 443 spiral about an axis (not shown) that passes through the center of crest 415 and is parallel to axis 408.

Figure 18:
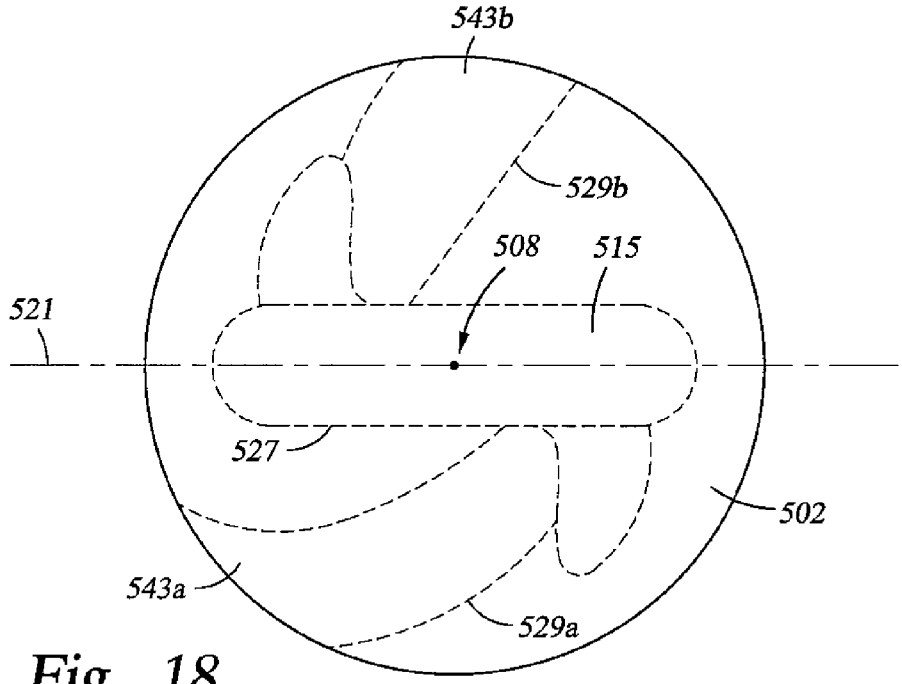

Referring now to FIG. 18, a cutter element 500 has an axis 508 and a cutting portion 502 including a straight elongate chisel crest 515 represented by a top profile 527 and a pair spiral flutes 543*a, b* represented by a top profiles 529*a, b*. Similar to insert 100 previously described, crest 515 extends along a straight crest median line 521 and crest transition surfaces 524*a, b* extend from opposite ends of opposite sides of crest 515 towards the base of insert 500. However, spiral flutes 543 rotate through different spiral angles. Specifically, in this embodiment, spiral flute 543*a* has a spiral angle of about 90°, while spiral flute 543*b* has a spiral angle of about 45°.

Figure 19:
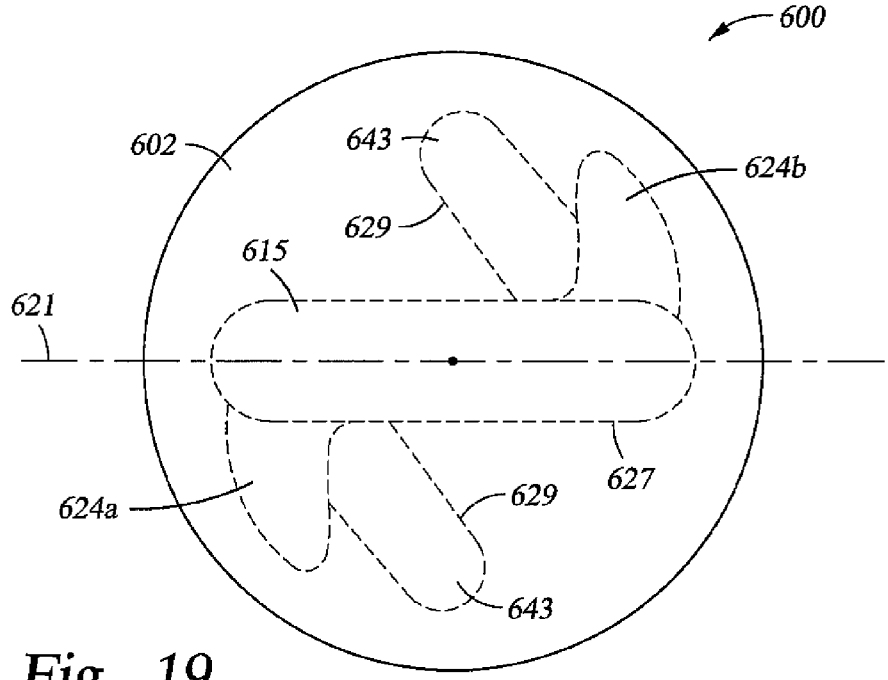

Referring now to FIG. 19, a cutter element 600 has an axis 608 and a cutting portion 602 including a straight elongate chisel crest 615 represented by a top profile 627 and a pair spiral flutes 643 represented by a top profiles 629. Similar to insert 100 previously described, crest 615 extends along a straight crest median line 621 and crest transition surfaces 624*a, b* extend from opposite ends of opposite sides of crest 615 towards the base of insert 600. However, in this embodiment, although spiral flutes 643 extend to crest 615, they do not extend completely to the base of insert 600. Rather, spiral flutes 643 extend from a region on cutting surface 603 intermediate the base of insert 600 and crest 615, to crest 615. More specifically, in this embodiment, spiral flutes 643 extend from proximal the base of insert 600 to crest 615.

The materials used in forming the various portions of the cutter elements described herein (e.g., inserts 100, 200, etc.) may be particularly tailored to best perform and best withstand the type of cutting duty experienced by that portion of the cutter element. For example, it is known that as a rolling cone cutter rotates within the borehole, different portions of a given insert will lead as the insert engages the formation and thereby be subjected to greater impact loading than a lagging or following portion of the same insert. With many conventional inserts, the entire cutter element was made of a single material, a material that of necessity was chosen as a compromise between the desired wear resistance or hardness and the necessary toughness. Likewise, certain conventional gage cutter elements include a portion that performs mainly side wall cutting, where a hard, wear resistant material is desirable, and another portion that performs more bottom hole cutting, where the requirement for toughness predominates over wear resistance. With the inserts described herein, the materials used in the different regions of the cutting portion can be varied and optimized to best meet the cutting demands of that particular portion.

More particularly, because the crest (e.g., crest 115) of the inserts described herein (e.g., insert 100) will likely experience more force per unit area upon the insert's engagement with the formation, it may be desirable, in certain applications, to form such portions of the inserts' with materials having differing characteristics. In particular, in at least one embodiment, crest 115 of insert 100 are made from a tougher, more facture-resistant material than spiral flutes 143.

Cemented tungsten carbide is a material formed of particular formulations of tungsten carbide and a cobalt binder (WC—Co) and has long been used as cutter elements due to the material's toughness and high wear resistance. Wear resistance can be determined by several ASTM standard test methods. It has been found that the ASTM B611 test correlates well with field performance in terms of relative insert wear life. It has further been found that the ASTM B771 test, which measures the fracture toughness (K1c) of cemented tungsten carbide material, correlates well with the insert breakage resistance in the field.

It is commonly known that the precise WC—Co composition can be varied to achieve a desired hardness and toughness. Usually, a carbide material with higher hardness indicates higher resistance to wear and also lower toughness or lower resistance to fracture. A carbide with higher fracture toughness normally has lower relative hardness and therefore lower resistance to wear. Therefore there is a trade-off in the material properties and grade selection.

It is understood that the wear resistance of a particular cemented tungsten carbide cobalt binder formulation is dependent upon the grain size of the tungsten carbide, as well as the percent, by weight, of cobalt that is mixed with the tungsten carbide. Although cobalt is the preferred binder metal, other binder metals, such as nickel and iron can be used advantageously. In general, for a particular weight percent of cobalt, the smaller the grain size of the tungsten carbide, the more wear resistant the material will be. Likewise, for a given grain size, the lower the weight percent of cobalt, the more wear resistant the material will be. However, another trait critical to the usefulness of a cutter element is its fracture toughness, or ability to withstand impact loading. In contrast to wear resistance, the fracture toughness of the material is increased with larger grain size tungsten carbide and greater percent weight of cobalt. Thus, fracture toughness and wear resistance tend to be inversely related. Grain size changes that increase the wear resistance of a given sample will decrease its fracture toughness, and vice versa.

As used herein to compare or claim physical characteristics (such as wear resistance, hardness or fracture-resistance) of different cutter element materials, the term "differs" or "different" means that the value or magnitude of the characteristic being compared varies by an amount that is greater than that resulting from accepted variances or tolerances normally associated with the manufacturing processes that are used to formulate the raw materials and to process and form those materials into a cutter element. Thus, materials selected so as to have the same nominal hardness or the same nominal wear resistance will not "differ," as that term has thus been defined, even though various samples of the material, if measured, would vary about the nominal value by a small amount.

There are today a number of commercially available cemented tungsten carbide grades that have differing, but in some cases overlapping, degrees of hardness, wear resistance, compressive strength and fracture toughness. Some of such grades are identified in U.S. Pat. No. 5,967,245, the entire disclosure of which is hereby incorporated by reference.

Inserts 100, 200 may be made in any conventional manner such as the process generally known as hot isostatic pressing (HIP). HIP techniques are well known manufacturing methods that employ high pressure and high temperature to consolidate metal, ceramic, or composite powder to fabricate components in desired shapes. Information regarding HIP techniques useful in forming inserts described herein may be found in the book *Hot Isostatic Processing* by H. V. Atkinson and B. A. Rickinson, published by IOP Publishing Ptd., ©1991 (ISBN 0-7503-0073-6), the entire disclosure of which is hereby incorporated by this reference. In addition to HIP processes, the inserts and clusters described herein can be made using other conventional manufacturing processes, such as hot pressing, rapid omnidirectional compaction, vacuum sintering, or sinter-HIP.

Embodiments of the inserts described herein (e.g., inserts 100, 200) may also include coatings comprising differing grades of super abrasives. Super abrasives are significantly harder than cemented tungsten carbide. As used herein, the term "super abrasive" means a material having a hardness of at least 2,700 Knoop (kg/mm$^2$). PCD grades have a hardness range of about 5,000-8,000 Knoop (kg/mm$^2$) while PCBN grades have hardnesses which fall within the range of about 2,700-3,500 Knoop (kg/mm$^2$). By way of comparison, conventional cemented tungsten carbide grades typically have a hardness of less than 1,500 Knoop (kg/mm$^2$). Such super abrasives may be applied to the cutting surfaces of all or some portions of the inserts. In many instances, improvements in wear resistance, bit life and durability may be achieved where only certain cutting portions of inserts 100, 200 include the super abrasive coating.

Certain methods of manufacturing cutter elements with PDC or PCBN coatings are well known. Examples of these methods are described, for example, in U.S. Pat. Nos. 5,766,394, 4,604,106, 4,629,373, 4,694,918 and 4,811,801, the disclosures of which are all incorporated herein by this reference.

As one specific example of employing superabrasives to insert 100, reference is again made to FIG. 3. As shown therein, crest 115 may be made of a relatively tough tungsten carbide, and be free of a superabrasive coating, such as diamond, given that it must withstand more impact loading than spiraled flutes 143. It is known that diamond coatings are susceptible to chipping and spalling of the diamond coating when subjected to repeated impact forces. However, spiral flutes 143 may be made of a first grade of tungsten carbide and coated with a diamond or other superabrasive coating to provide the desired wear resistance as cutting portion 102 penetrates into the formation.

Thus, according to these examples, employing multiple materials and/or selective use of superabrasives, the bit designer, and ultimately the driller, is provided with the opportunity to increase ROP, and bit durability.

While preferred embodiments have been shown and described, modifications thereof can be made by one skilled in the art without departing from the spirit or teaching herein. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A cutting element for a drill bit comprising:

a base portion having a central axis; and a cutting portion extending from the base portion and having a cutting surface;

wherein the cutting surface includes an elongate chisel crest and at least one flute that extends along the cutting surface to the elongate chisel crest, and wherein the cutting surface comprises a twisted geometry in which the at least one flute forms a spiral as it extends to the elongate chisel crest, such that successive cross-sections of the cutting portion, taken perpendicular to the central axis, each comprises a longitudinal sectional axis that is rotated with respect to the longitudinal sectional axis of the successive cross-section.

2. The cutting element of claim 1 wherein the at least one flute extends along the cutting surface from proximal the base portion to the elongate chisel crest.

3. The cutting element of claim 1 wherein the at least one flute spirals about the central axis and has a spiral angle between 30° and 180°.

4. The cutting element of claim 3 wherein the at least one spiral flute has a spiral angle between 30° and 90°.

5. The cutting element of claim 1 comprising two flutes, each flute extending to the elongate chisel crest and spiraling about the central axis of the base portion, wherein the two flutes are circumferentially spaced apart by about 180° and each flute has a spiral angle between 30° and 90°.

6. The cutting element of claim 5 wherein the elongate chisel crest extends linearly between a first crest end and a second crest end along a straight crest median line in top view.

7. The cutting element of claim 5 wherein each spiral flute extends between the base portion and the elongate chisel crest, wherein the elongate chisel crest extends laterally between a first lateral side and a second lateral side, and wherein one of the two spiral flutes extends from the base portion to the first lateral side of the elongate chisel crest proximal the first crest end, and the other of the two spiral flutes extends from the base portion to the second lateral side of the elongate chisel crest proximal the second crest end.

8. The cutting element of claim 5 wherein the elongate chisel crest comprises an S-shaped crest extending between a first crest end and a second crest end in top profile.

9. The cutting element of claim 1, wherein the cutting surface comprises a first material at the elongate chisel crest and a second different material at the at least one flute.

10. The cutting element of claim 1, wherein the elongate chisel crest is offset from the central axis.

11. The cutting element of claim 1, wherein the at least one flute spirals about an axis that is offset from the central axis.

12. The cutting element of claim 1, wherein the cutting surface further comprises transition surfaces between the elongate chisel crest and the at least one flute such that the cutting surface is continuously contoured.

13. A drill bit for cutting a borehole having a borehole sidewall, corner and bottom, the drill bit comprising:

a bit body including a bit axis;

a rolling cone cutter mounted on the bit body and adapted for rotation about a cone axis;

at least one insert having a base portion secured in the rolling cone cutter and having a cutting portion extending therefrom, wherein the cutting portion has a cutting surface including an elongate chisel crest and at least one flute that extends along the cutting surface to the elongate chisel crest, wherein the at least one insert has a central axis and wherein the at least one flute is a spiral flute that spirals about the central axis, such that successive cross-sections of the cutting portion, taken perpendicular to the central axis, each comprises a longitudinal sectional axis that is rotated with respect to the longitudinal sectional axis of the successive cross-section.

14. The drill bit of claim 13 wherein the elongate chisel crest extends between a first crest end and a second crest end along a crest median line that is substantially straight in top view.

15. The drill bit of claim 14 wherein the at least one insert is oriented in the rolling cone cutter such that a projection of the median line intersects the cone axis.

16. The drill bit of claim 14 wherein the insert is positioned in the rolling cone cutter such that the first crest end is closer to the borehole sidewall than to the bit axis.

17. The drill bit of claim 13 wherein the at least one flute extends from the base portion to the elongate chisel crest.

18. The drill bit of claim 13 wherein the at least one flute has a spiral angle between 30° and 90°.

19. The drill bit of claim 18 wherein the cutting surface of the at least one insert comprises two flutes, each flute extending to the elongate chisel crest and spiraling about the central axis of the at least one insert through a spiral angle between 30° and 90°.

20. The drill bit of claim 19 wherein the two flutes of the at least one insert are circumferentially spaced apart by about 180°.

21. The drill bit of claim 20 wherein the two flutes of the at least one insert each have substantially the same spiral angle.

22. The drill bit of claim 21 wherein the elongate chisel crest extends between a first crest end and a second crest end along a crest median line and extends laterally between a first lateral side and a second lateral side, and wherein one of the two flutes extends from the base portion to the first lateral side of the elongate chisel crest proximal the first crest end, and the other of the two flutes extends from the base portion to the second lateral side of the elongate chisel crest proximal the second crest end.

23. The drill bit of claim 13 comprising a circumferential row of inserts, each insert in the circumferential row having a central axis and comprising a cutting portion having a cutting surface including an elongate chisel crest and at least one flute that spirals about the central axis.

24. The drill bit of claim 23 wherein each insert in the circumferential row comprises two flutes spaced circumferentially apart by 180°, each flute spiraling about the central axis of its respective insert.

25. The drill bit of claim 13, wherein the cutting surface further comprises transition surfaces between the elongate chisel crest and the at least one flute such that the cutting surface is continuously contoured.

26. A drill bit for cutting a borehole having a borehole sidewall, corner and bottom, the drill bit comprising:

a bit body including a bit axis;

a rolling cone cutter mounted on the bit body and adapted for rotation about a cone axis;

a plurality of inserts mounted in an inner row on the rolling cone cutter;

wherein each insert comprises a base portion secured in the rolling cone cutter and a cutting portion extending from the base portion, the base portion having a central axis, the cutting portion having a cutting surface including an elongate chisel crest and at least one flute extending in a spiral about the cutting surface such that successive cross-sections of the cutting portion, taken perpendicular to the central axis, each comprise a longitudinal sectional axis that is rotated with respect to the longitudinal sectional axis of the successive cross-section, and wherein the cutting surface further comprises transition surfaces between the elongate chisel crest and the at least one flute such that the cutting surface is continuously contoured.

27. The drill bit of claim 26 wherein the at least one flute on each of the plurality of inserts spirals about the central axis.

28. The drill bit of claim 27 wherein the at least one flute on each of the plurality of inserts extends substantially to the crest.

29. The drill bit of claim 26 wherein the cutting portion of each of the plurality of inserts comprises two or more flutes, wherein each flute extends in a spiral about the central axis of its respective insert, wherein each flute has a spiral angle between 30° and 90°, and wherein the spiral angle of each flute is substantially the same.

* * * * *